US011672357B2

(12) United States Patent
Scarleski

(10) Patent No.: US 11,672,357 B2
(45) **Date of Patent: *Jun. 13, 2023**

(54) ACTIVE MATTRESS ENCASEMENT

(71) Applicant: Levitation Sciences LLC, Chicago, IL (US)

(72) Inventor: William John Scarleski, Chicago, IL (US)

(73) Assignee: Levitation Sciences LLC, St. Petersburg, FL (US)

( * ) Notice: Subject to any disclaimer, the term of this patent is extended or adjusted under 35 U.S.C. 154(b) by 292 days.

This patent is subject to a terminal disclaimer.

(21) Appl. No.: 16/844,486

(22) Filed: Apr. 9, 2020

(65) Prior Publication Data

US 2020/0367664 A1 Nov. 26, 2020

Related U.S. Application Data

(60) Continuation of application No. 15/209,503, filed on Jul. 13, 2016, now abandoned, which is a division of (Continued)

(51) Int. Cl.
*A47C 31/10* (2006.01)
*A47C 27/08* (2006.01)

(Continued)

(52) U.S. Cl.
CPC ..... *A47C 31/105* (2013.01); *A47C 21/028* (2013.01); *A47C 21/06* (2013.01);

(Continued)

(58) Field of Classification Search
CPC ..... A47C 21/022; A47C 21/028; A47C 21/06; A47C 27/087; A47C 31/105; A61G 7/1028; Y10T 29/49826
See application file for complete search history.

(56) References Cited

U.S. PATENT DOCUMENTS 2,400,731 A 5/1946 Armstrong
2,849,729 A 9/1958 Goodey, Jr. et al.

(Continued)

FOREIGN PATENT DOCUMENTS

CN 204427422 U * 7/2015
EP 1106115 6/2001

(Continued)

OTHER PUBLICATIONS http:/questoutfitters.com/coated.html—May 6, 2010.

(Continued)

*Primary Examiner* — David R Hare
(74) *Attorney, Agent, or Firm* — Amundsen Davis, LLC

(57) ABSTRACT

An active mattress encasement which can be relatively easily installed or removed or rotated over a mattress supported by a foundation is disclosed. The encasement is formed to encapsulate a mattress and may include a top panel, a bottom panel and multiple side panels. One or more of the side panels are zippered together, In one embodiment, the un-zippered side panels, i.e. side panels without zippers, fixedly connect the top and bottom portions of the side panels. In another embodiment, an inflatable volume is integrated into the bottom panel. Alternatively, the inflatable volume may be integrated with a separate detachable cover and attached to the bottom panel by conventional means. The top and bottom panels, as well as the side panels may be made from a conventional materials. The underside of the top panel and optionally the inside of the side panels may be coated with a waterproof coating, such as polyurethane (TPU/PU), silicone, and/or urethane to form a waterproof membrane. In accordance with an important aspect of one embodiment of the invention, an interior surface of the bottom panel is formed with a slick surface while the (Continued)

*Fig. 2a* exterior surface of the bottom panel is integrated with an inflatable volume. The inflatable volume faces outwardly and is adapted to be in contact with the foundation or optional bed skirt. In this embodiment, the exterior surface of the bottom panel of the encasement is formed at least partially with a non-slick surface. The non-slick surface provides a frictional relationship between the exterior surface of the bottom panel of the encasement and the foundation or bed skirt while the encasement is being installed or removed over a mattress. The slick interior surface of the bottom panel allows a mattress to be rotated, installed, or removed, once the bottom panel is juxtaposed between the mattress and the foundation in an application in which the encasement is unzipped and the top panel is disposed on the floor adjacent one end of the mattress. Alternatively, a separate detachable cover may be used to allow the mattress to be relatively easily installed or removed or rotated with the encasement fully installed on the mattress. Optional straps may be provided, fixedly attached to the encasement, to allow the encasement to be snugged against the mattress. This enables the encasement to be used with a relatively wide range of mattress sizes and still provide a snug fit.

16 Claims, 31 Drawing Sheets

Related U.S. Application Data application No. 14/046,047, filed on Oct. 4, 2013, now Pat. No. 9,596,946.

(51) Int. Cl.
*A47C 21/06* (2006.01)
*A47C 21/02* (2006.01)
*A61G 7/10* (2006.01)

(52) U.S. Cl.
CPC ..... *A47C 27/087* (2013.01); *A61G 7/1028* (2013.01); *Y10T 29/49826* (2015.01)

(56) References Cited

U.S. PATENT DOCUMENTS 3,261,177 A 7/1966 Amann et al.
3,392,412 A 7/1968 Aymar
3,392,723 A 7/1968 Calvin
3,416,626 A 12/1968 Nagamatsu
3,667,073 A 6/1972 Renfro
4,046,317 A 9/1977 Hein, Jr.
4,095,299 A 6/1978 Schweiso
4,142,263 A 3/1979 Pierson
4,155,421 A 5/1979 Johnson et al.
4,164,797 A 8/1979 Golembeck
4,517,690 A 5/1985 Wegener
4,807,313 A 2/1989 Ryder et al.
4,944,053 A 7/1990 Smith
5,022,110 A 6/1991 Stroh
5,088,952 A 2/1992 Goldblatt
5,168,589 A 12/1992 Stroh et al.
5,244,452 A 9/1993 Vaccaro et al.
5,257,430 A 11/1993 Yamaguchi
5,313,679 A 5/1994 Yoshihisa
5,318,481 A 6/1994 St-Germain
5,360,363 A 11/1994 Levin
5,414,882 A 5/1995 Goodale
5,473,783 A 12/1995 Allen
5,488,746 A 2/1996 Hudson
5,628,077 A 5/1997 Briganti
5,631,074 A 5/1997 Herlihy
5,632,054 A 5/1997 Hutton et al.
5,815,865 A 10/1998 Washburn et al.
5,860,174 A 1/1999 Failor
5,960,496 A 10/1999 Boyd
6,073,291 A 6/2000 Davis
6,161,235 A 12/2000 Smith et al.
6,212,718 B1 4/2001 Stolpmann et al.
6,274,520 B1 8/2001 Cordell
6,381,778 B1 5/2002 Peterson
6,457,196 B1 10/2002 Dykes et al.
6,557,194 B1 5/2003 Jeffries et al.
6,684,434 B2 2/2004 Ellis et al.
6,728,978 B1 5/2004 Nordin
6,795,989 B2 9/2004 Fairchild et al.
6,859,967 B2 3/2005 Harrison et al.
6,886,203 B2 5/2005 Drakos
6,966,083 B1 11/2005 Cheng
7,051,388 B1 * 5/2006 Taddeo ..... A47C 21/026 5/486
7,120,952 B1 10/2006 Bass et al.
7,155,762 B2 1/2007 Harrow
7,481,290 B2 1/2009 Pendzich
7,581,270 B1 9/2009 Levesque
7,617,553 B1 11/2009 Faiola
7,617,556 B2 11/2009 Rensink
7,644,671 B2 1/2010 Smith
7,725,963 B2 6/2010 Johnson
7,730,567 B2 6/2010 Jaeger
7,735,164 B1 6/2010 Patrick
7,849,533 B1 12/2010 Receveur et al.
7,917,979 B2 4/2011 Amsler, Jr. et al.
7,975,330 B2 7/2011 Receveur et al.
8,006,331 B1 * 8/2011 Scarleski ..... A47C 21/028 5/81.1 RP
8,087,111 B2 1/2012 Paris
8,122,541 B1 2/2012 Georgatos
8,156,588 B2 4/2012 Svoboda
8,201,292 B2 6/2012 Dionne et al.
8,246,706 B2 8/2012 Scarleski
8,510,880 B2 8/2013 Scarleski
8,549,681 B2 10/2013 Scarleski
8,863,326 B2 10/2014 Scarleski
9,021,630 B2 5/2015 Scarleski
9,596,946 B2 * 3/2017 Scarleski ..... A61G 7/1028
9,814,324 B2 * 11/2017 Scarleski ..... A47C 31/105
10,327,562 B2 6/2019 Scarleski
2003/0029062 A1 2/2003 Esterman
2003/0079292 A1 5/2003 Ellis et al.
2003/0226206 A1 12/2003 Ben-Levi
2004/0133978 A1 7/2004 Fairchild
2004/0226089 A1 11/2004 Miranda
2005/0000025 A1 1/2005 Metzger et al.
2005/0114998 A1 * 6/2005 Leventhal ..... A47C 20/048 5/615
2005/0172412 A1 8/2005 Pearson
2005/0229318 A1 10/2005 Peng
2006/0010608 A1 1/2006 DeFranks et al.
2007/0022533 A1 2/2007 Borino
2007/0251017 A1 11/2007 Speer et al.
2008/0028522 A1 2/2008 Atwood
2008/0040858 A1 2/2008 Sakaldasis et al.
2008/0096001 A1 4/2008 Emden et al.
2008/0141463 A1 6/2008 Dionne
2008/0256715 A1 10/2008 Jones
2008/0264983 A1 10/2008 Kastan
2008/0301876 A1 12/2008 Kenalty et al.
2009/0004452 A1 1/2009 Assink
2009/0056030 A1 3/2009 Bolden
2009/0083909 A1 4/2009 Amsler, Jr.
2009/0106893 A1 4/2009 Blevins
2010/0258344 A1 10/2010 Creasy, Jr.
2011/0010856 A1 1/2011 Bell
2011/0041247 A1 2/2011 Moon
2011/0099713 A1 5/2011 Gonser, Jr.
2011/0185508 A1 8/2011 Hsu et al.
2011/0265268 A1 11/2011 Scarleski
2011/0265269 A1 11/2011 Scarleski
2011/0278888 A1 11/2011 Miles

(56) References Cited

U.S. PATENT DOCUMENTS

| | | | |
|---|---|---|---|
| 2011/0289685 | A1 | 12/2011 | Romano et al. |
| 2012/0117778 | A1 | 5/2012 | Scarleski |
| 2012/0137433 | A1 | 6/2012 | Snell et al. |
| 2012/0151680 | A1 | 6/2012 | Scarleski |
| 2012/0167302 | A1 | 7/2012 | Malouf |
| 2012/0167307 | A1 | 7/2012 | Michael |
| 2012/0174323 | A1 | 7/2012 | Platek |
| 2012/0192356 | A1 | 8/2012 | Svoboda |
| 2012/0246834 | A1 | 10/2012 | Scarleski |
| 2012/0255120 | A1 | 10/2012 | Poston et al. |
| 2012/0260426 | A1 | 10/2012 | Dobin |
| 2012/0260432 | A1 | 10/2012 | Scarleski |
| 2013/0019411 | A1 | 1/2013 | Scarleski |
| 2013/0139316 | A1 | 6/2013 | Rabbany et al. |
| 2013/0174349 | A1 | 7/2013 | Amaral et al. |
| 2013/0212809 | A1 | 8/2013 | Scarleski |
| 2013/0232698 | A1 | 9/2013 | Ward |
| 2014/0026318 | A1 | 1/2014 | Bethel et al. |
| 2014/0150181 | A1 | 6/2014 | Tulloch |

FOREIGN PATENT DOCUMENTS

| | | | | |
|---|---|---|---|---|
| EP | 1645258 | | 4/2006 | |
| EP | 1852151 | A1 * | 11/2007 | ..... A63B 5/00 |
| EP | 2866616 | | 5/2015 | |
| WO | WO 2011139890 | | 11/2011 | |
| WO | WO 2011139892 | | 11/2011 | |
| WO | WO 2014004661 | | 1/2014 | |
| WO | WO 2014143124 | | 9/2014 | |

OTHER PUBLICATIONS http:/www.rockywoods.com—May 6, 2010.
http:/www.rockyvvoods.com/Fabrics-Hardware-Patterns-Kits/Medium-Weight-Nylon-Fabrics/Heat-Sealable-70-Denier-Nylon-Taffeta—May 6, 2010.
http:/wwvv2.dupont.com/Products and_Services/en VN/nwyn.html—May 6, 2010.
http:/www.seattlefabrics.com/nylons.html—May 6, 2010.
http:/www.mattressdirectonline.com—May 5, 2010.
http:/www.nextag.com/INVACARE-MicroAir-Lateral-Rotation-628052627/prices-html Sep. 14, 2009.
http:/luncyclopedia.wikia.com/wiki/Mattress racing—Sep. 14, 2009.
http:/www.primeconveyor.com/productDetail.asp_Q_catID_E_92_A_subCatID_E_129_September 14, 2009.
European Communication Pursuant to Article 94(3) EPC for Application No. 14851218.9 dated Apr. 24, 2020 (7 pages).
Canadian Examination Report from the Canadian Patent Office for Application No. 2,929,587 dated Nov. 18, 2019 (4 pages).
Canadian Examination Report from the Canadian Patent Office for Application No. 2,929,587 dated Jun. 17, 2020 (5 pages).
Australian Examination Report from the Australian Patent Office for Application No. 2019203938 dated Jun. 18, 2020 (3 pages).
Examination Report from the Australian Patent Office for Application No. 2021204398 dated Aug. 18, 2022 (3 pages).
Canadian Examination Report from the Canadian Patent Office for Application No. 2,929,589 dated Dec. 31, 2020 (3 pages).
EP21194124.0 Extended European Search Report dated Apr. 7, 2022 (12 pages).
Examination Report from the Australian Patent Office for Application No. 2021204398 dated May 6, 2022 (6 pages).

* cited by examiner

Fig. 16
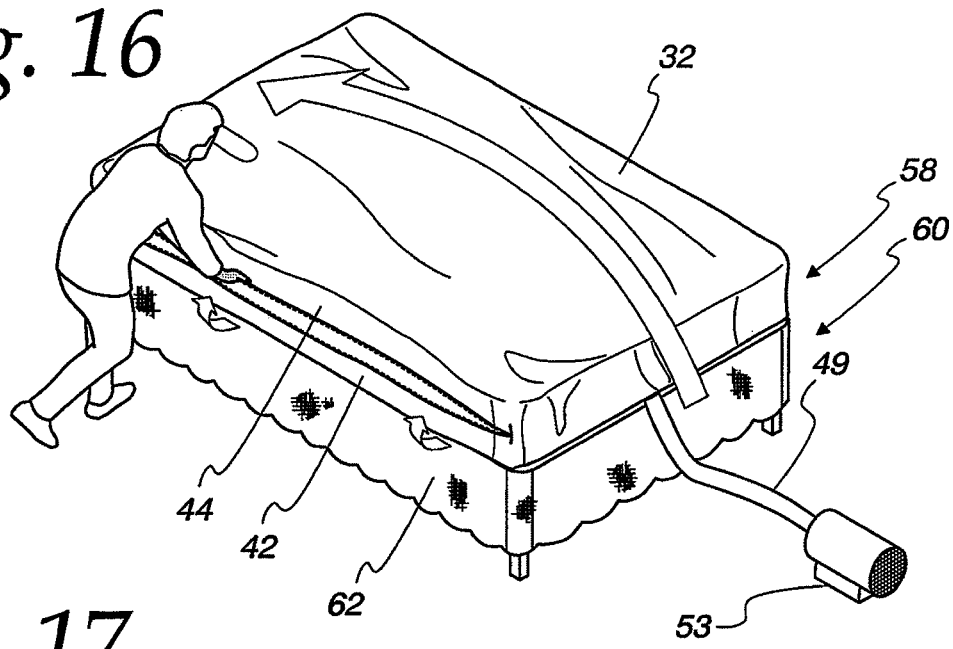
Fig. 17
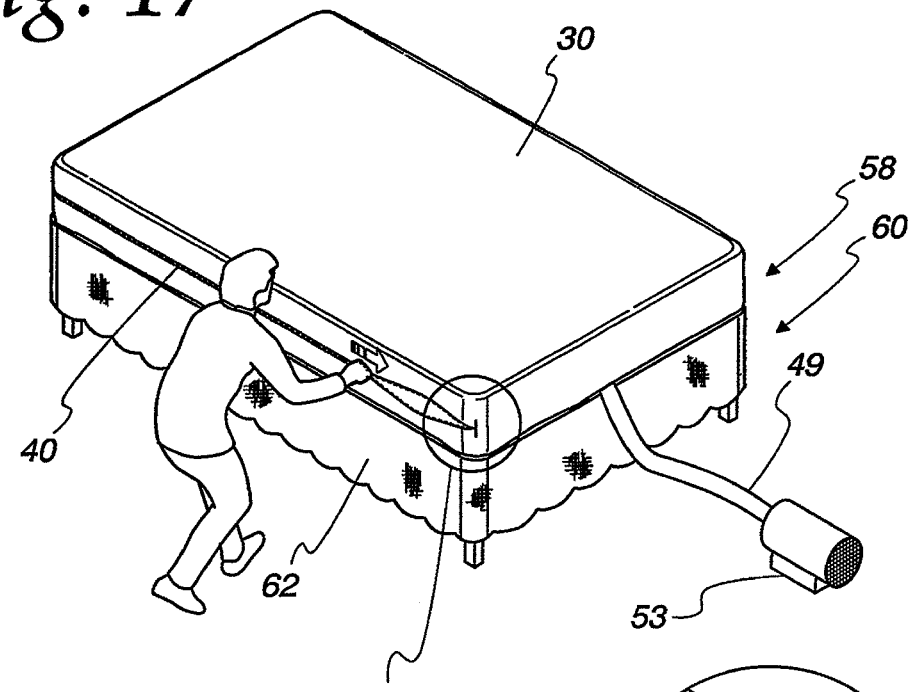
Fig. 17a
Fig. 17a
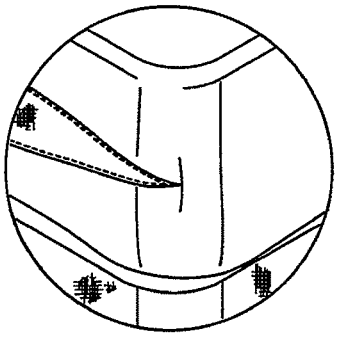

ACTIVE MATTRESS ENCASEMENT

BACKGROUND OF THE INVENTION

1. Field of the Invention

The present invention relates to an active encasement which can be installed or removed relatively easily over a mattress supported by a foundation or fixed or adjustable platform (hereinafter "foundation") which also facilitates bed making and rotation of the mattress even in applications in which a bed skirt is installed over a foundation and can accommodate a relatively wide range of mattress sizes.

2. Description of the Prior Art

Mattress encasements are used as a prophylactic cover over an entire mattress to protect the mattress from various situations, such as parasites and stains, for example, pet stains. Such encasements are also available for box springs. Examples of such encasements are disclosed in US Patent Application Publication Nos.: US 2012/0260426; US 2012/0255120; 2012/0192356; 2012/0167302; and 2011/00100856 as well as U.S. Pat. Nos. 8,087,111 and 8,156,588, all hereinafter incorporated by reference.

Some known encasements are made from a vinyl material. There are several problems with such vinyl encasements. One such problem is that they are uncomfortable. Another problem relates to cleaning them after being in contact with blood, urine or other matter. Such vinyl encasements cannot be laundered. In order to solve this problem, encasements made from launderable materials have been developed. For example, U.S. Pat. No. 8,087,111 discloses an encasement formed from two layers; an inner layer and an outer layer. The outer layer is formed from cotton or other common encasement material or a material commonly used for mattress protectors, as well as bedding fabric, such as polyester or a polyester-cotton blend. The inner layer is formed as a waterproof membrane, for example, a polyurethane or other suitable waterproof coating.

Because of the need for laundering, some known encasements are formed with a zipper along one to three sides forming a pocket on one end for installation and removal for laundering. In order to launder the encasement, the mattress is normally flipped upside down so that the mattress top is in contact with the foundation and the dust cover is facing upwardly. Next, the mattress is slid off one end to enable the pocket to be slipped over one end of the mattress. The encasement is then slipped over the rest of the mattress. The mattress is again flipped over so that the dust cover is resting on the foundation and the comfort top is facing upwardly. The top layer of the encasement with the waterproof membrane is then zipped to the bottom layer to complete the installation. In order to remove an encasement, the zipper is unzipped along one or more sides and the mattress is lifted from the foundation to remove the encasement.

Mattresses are relatively heavy items. The weight of a mattress varies as a function of the coil core size, the gauge of the coil and the type of foam material used. An average king size mattress weighs between 85 and 115 pounds. High end king size mattresses with latex or memory foam can weigh as much as 300 pounds (http:/www.mattressdirectonline.com). As such, lifting the mattress to remove the encasement and flipping it over twice to install a clean encasement can be an extremely difficult task, especially in hotels and motels where multiple encasements must be changed in a single day.

Another problem relates to rotation of a mattress that is encased in an encasement. For one thing, the mattress handles are covered by the encasement making an encased mattress difficult to lift and rotate. The problem is especially acute if there is a bed skirt on the foundation. In that case, rotation of the mattress would move the bed skirt out of position, essentially requiring the mattress to be rotated by lifting the mattress and rotating the mattress while lifted relative to the foundation.

Another problem relates to the fact that there is no standard size for a mattress. Commonly available mattresses are normally 4" to 18" in depth. Some available mattresses are 20" in depth or more. Although the length and width measurements of various mattresses are fairly standard, there are known differences in the lengths and the perimeters of the various mattresses. Although different encasement sizes are manufactured to accommodate the various mattress depths, known encasements do not address the differences in mattress and perimeter lengths. As such, the encasements, depending on the mattress size, do not always provide a snug fit relative to the mattress, which is highly undesirable from a housekeeping standpoint.

Another known problem relates to bed making. In particular, hotel and motel chains as well as healthcare facilities which include hospitals, nursing homes and extended care facilities (hereinafter "commercial facilities") are known to encase their mattresses and box springs in encasements. Such commercial facilities are also known to only use flat sheets in their facilities due to the lower cost of flat sheets relative to fitted sheets and the desire to maintain fewer items in their respective inventories. As such, in order to properly make the beds in such facilities which utilize flat sheets, housekeeping personnel need to lift the mattress, which can be quite heavy, as discussed above. More particularly, in such facilities, beds are made with a top sheet and a bottom sheet and a blanket. Both the top sheet and the bottom sheets are flat sheets. In order to properly make the bed, the top and bottom sheets are tucked in between the top mattress and the box spring. More specifically, the bottom sheet is placed on the bed, so that an equal amount of the sheet hangs off each side of the bed and an equal amount of the sheet hangs off the head and foot regions of the bed. The excess is tucked in at the head and foot regions of the bed to form so called "hospital corners". Next, the excess portions of the bottom sheet are tucked in between the mattress and the foundation. The top sheet is then placed on top of the bottom sheet and placed and tucked in the same manner as the bottom sheet with hospital style corners except the head region is left open. In other words, only the foot and side portions of the top sheet are tucked between the mattress and the box spring. Next, a blanket is placed on the bed and may be tucked in the same manner as the top sheet.

In order to tuck the top and bottom sheets between the mattress and the box spring, the top mattress must normally be lifted. As mentioned above, mattresses can weigh up to 300 pounds. In order to make a bed, a housekeeping employee may need to lift a mattress up to ten (10) times per bed. Assuming that each housekeeping employee in a hotel, motel or healthcare facility makes at least 15-30 beds in a single shift, each housekeeping employee would typically lift a mattress at least 150-300 times per shift. Since bed making is a daily chore, housekeeping employees probably lift mattresses 150-200 times per shift on a daily basis.

Such sustained and repetitive lifting may lead to employees developing various repetitive injury problems, resulting in employees missing work or, in severe cases, being placed on disability. Measures have been taken to mitigate such health problems. For example, simply using fitted sheets for the lower sheet reduces the number of times the mattress is to be lifted by, an estimated 40%. However, fitted sheets do not allow for the bottom sheets to be made into "hospital corners" that hospitals are known for. Moreover, even using fitted sheets for the bottom sheet still requires a housekeeping employee to lift mattresses at least 90-160 times per day using the example above.

Moreover, the use of fitted sheets is not without its drawbacks. For example, fitted sheets cost more than flat sheets. In addition, fitted sheets increase the sheet inventory of hotels and motels since both fitted and flat sheets must be stocked. Also, frequent washing of sheets in commercial facilities tends to wear out the elastic in fitted sheets. As such, fitted sheets used in such facilities need to be replaced in applications in commercial facilities more frequently than straight sheets.

Thus, there is a need for an encasement that can easily be installed or removed for changing or laundering that facilitates bed making as well as rotation of a mattress to even out body impressions, even in applications which include a bed skirt and can accommodate a range of mattress sizes. There is also a need for further minimizing or eliminating the need for housekeeping employees to lift mattresses while tucking in unfitted flat sheets while still providing "hospital corners" on the made beds.

SUMMARY OF THE INVENTION

Briefly, the present invention relates to an active encasement which can be relatively easily installed or removed over a mattress supported by a foundation. The encasement is formed to encapsulate a mattress and includes a top panel, a bottom panel and four side panels. One or more of the four side panels are zippered together. In an embodiment with one, two, or three zippered side panels, the un-zippered side panels may be configured to fixedly connect the top panel to the bottom panel. In one embodiment, an inflatable volume is integrated into the bottom panel. In an alternative embodiment, the inflatable volume may be integrated with a separate detachable cover and attached to the bottom panel by conventional means. The top and bottom panels as well as the side panels may be formed from a conventional or non-conventional encasement material or a material commonly used for mattress protectors, as well as conventional bedding material and/or waterproof and/or spill proof and/or moisture proof and/or anti-bacterial and/or anti-allergen and/or anti-dust-mite and/or bed bug proof material, such as TPU polyurethane coated terry cotton, polyester knit, vinyl, bamboo fabric, or silver infused or coated type material, or any combination of the above (hereinafter "materials"). The underside of the top panel and optionally the inside of the side panels may be coated, embossed or otherwise covered with a waterproof layer or coating, such as polyurethane, to form a waterproof membrane. In accordance with an important aspect of one embodiment of the invention, an interior surface of the bottom panel of the encasement is formed with a slick surface while the exterior surface of the bottom panel is integrated with an inflatable volume that faces outwardly and is adapted to be in contact with the foundation or bed skirt. In this embodiment, the exterior surface of the bottom panel of the encasement is formed as a non-slick surface. The non-slick surface provides a frictional relationship between the exterior surface of the bottom panel of the encasement and the foundation or bed skirt while the encasement is being installed, removed, or rotated with respect to a mattress, relative to the foundation. The slick interior surface of the bottom panel allows a mattress to be rotated once the bottom panel is juxtaposed between the mattress and the foundation in an application in which the encasement is unzipped and the top panel is disposed on the floor adjacent one end of the mattress. Alternatively, a separate detachable cover may be used to allow the mattress to be rotated with the encasement fully installed on the mattress. Optional straps may be provided, rigidly affixed to the encasement. These straps allow the encasement to be snugged against the mattress to enable the encasement to be used with a relatively wide range of mattress sizes and still provide a snug fit.

DESCRIPTION OF THE DRAWING

These and other advantages of the present invention will be readily understood with reference to the following specification and attached drawing wherein:

FIG. 10*a* is a partial enlarged view of a portion of the bottom panel of the encasement illustrating the air flow there through.

FIG. 16 illustrates a top panel of the encasement being placed over the top of the mattress, shown with the pump connected to the inflatable volume which is integrated into the bottom panel of the encasement.

FIG. 17 is similar to FIG. 16 shown with an upper side panel portion of a side panel and a lower side panel portion the side panel being zipped together.

FIG. 17*a* is an enlarged partial view of a portion of one corner of mattress and foundation illustrated in FIG. 16, illustrating the zipper on the encasement partially unzipped.

DETAILED DESCRIPTION

Figure 1A:
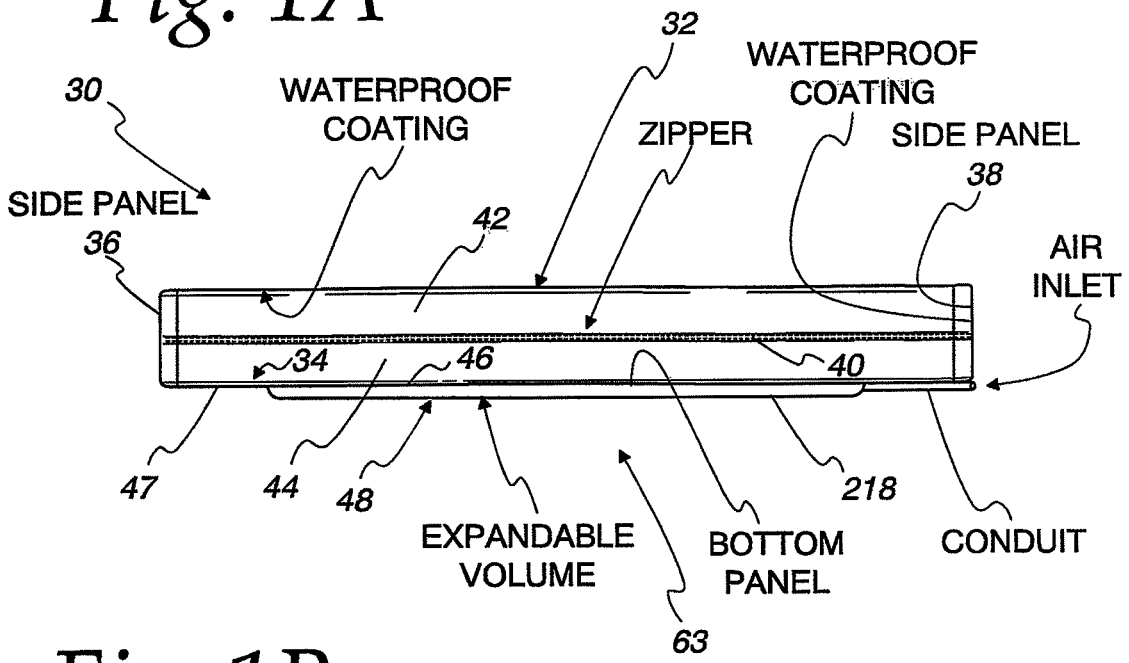
FIG. 1*a* is a front elevational view of one embodiment of an active encasement with an integrated inflatable volume in accordance with the present invention.

The present invention relates to an active encasement which can be relatively easily installed or removed over a mattress supported by a foundation. The encasement is formed to encapsulate a mattress and includes a top panel, a bottom panel and optional four side panels and a conventional, or alternatively, a non-conventional, zipper and zipper enclosure, as well as zippers and zipper enclosures typically used for encasements (hereinafter "zipper"). The active encasement also includes an inflatable volume. As used herein, a side panel is understood to mean those portions or the encasement that contact the side panels of the mattress when the encasement is installed. One or more of the side panels are zippered together. In embodiments in which one, two, or three panels are zippered together, the un-zippered side panel(s) may be configured to fixedly connect the top panel to the bottom panel. The top and bottom panels, as well as the side panels, may be made from a conventional encasement material or a material commonly used for mattress protectors, as well as conventional bedding material, as described above. The underside of the top panel and optionally the inside of the side panels may be coated with a waterproof coating, such as polyurethane, to form a waterproof membrane.

In alternative embodiments, the bottom panel may be integrally formed to attach directly to the side panels of the encasement. In this embodiment, the top panel and side panels may be integrally formed and zippered directly to the bottom panel. Alternatively, the bottom panel and side panel may be integrally formed and zippered directly to the top panel.

In another alternative embodiment, the encasement may be formed with an oversized top and bottom panels that are zippered together on at least one side. The top and bottom panels are sized to cover the top and bottom surfaces of a mattress as well as the four side surfaces of the mattress. An extending portion which extends from the top and bottom surfaces of the mattress fits up against the side surfaces of the mattress. In this embodiment, one, two, three or four edges of the top and bottom panels may be zippered. In accordance with an important aspect of one embodiment of the invention, the bottom panel is formed with a slick interior surface and a non-slick exterior surface. The exterior non-slick surface allows a mattress to be rotated while maintaining the position of the bottom panel of the encasement relative to the foundation and without affecting the position of an underlying bed skirt in applications in which a bed skirt is covering the foundation while the slick interior surface facilitates rotation of the mattress. The present invention also facilitates installation and removal of the encasement over a mattress or a foundation, such as a box spring while eliminating the need to lift or flip the mattress.

Optional straps may be provided, rigidly affixed to the encasement. The straps allow the encasement to be snugged against the mattress or foundation to enable the encasement to be used with a relatively wide range of mattress and foundation depths and still provide a snug fit.

In embodiments in which the inflatable volume is formed as part of a separate cover, the cover is simply detached from the encasement and attached to the foundation which may be covered with a bed skirt. In this application, the mattress can be rotated with the encasement fully installed with respect to the mattress. After the mattress is rotated, for example, 180 degrees, the separate cover with the integral inflatable volume may be reattached to the mattress.

Four embodiments of the invention are contemplated. In a first embodiment, the inflatable volume is integrally formed in a bottom panel of the encasement. In a second embodiment of the invention the inflatable volume is integrally formed in a detachable separate cover. In a third embodiment, a separate cover is used with the first embodiment. All three embodiments are illustrated and described below. In a fourth embodiment, the encasement is formed with extended side panels that can be folded over to overlap the bottom panel and be attached thereto.

Figure 22:
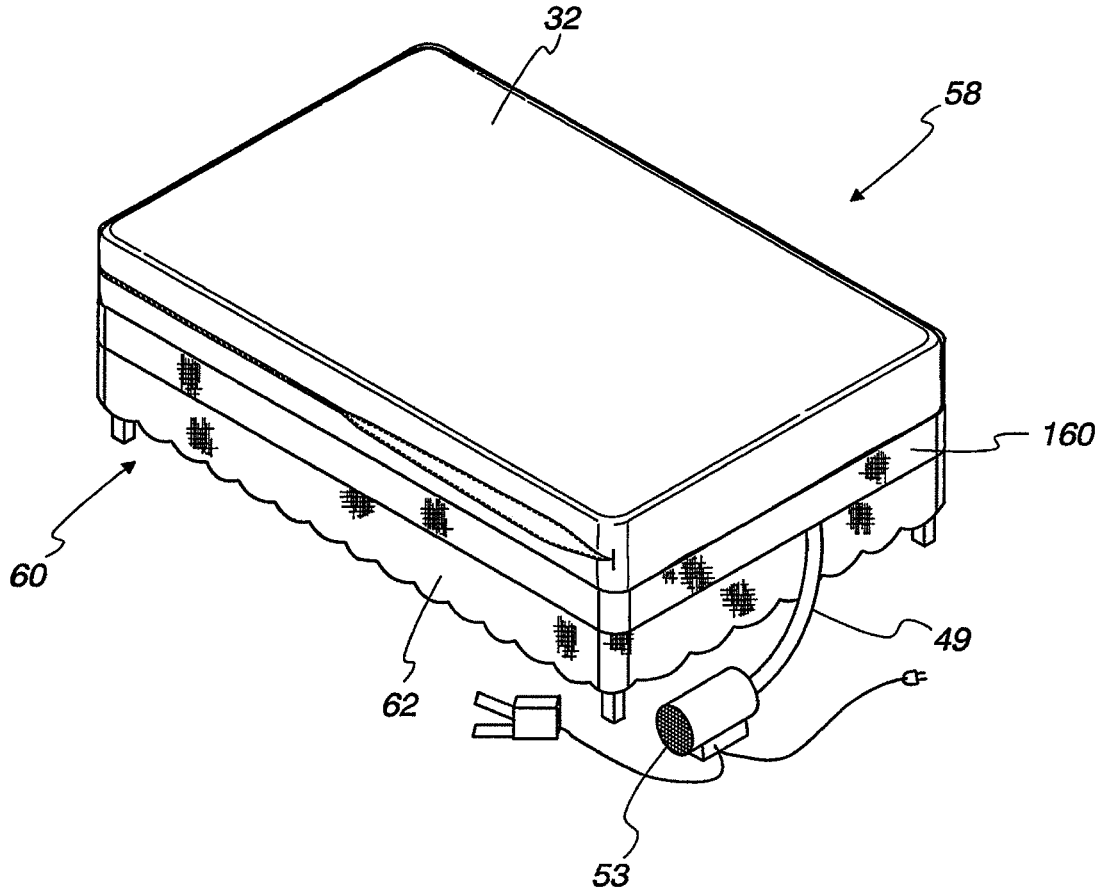
FIG. 22 is an isometric drawing of an alternative embodiment of the invention, as illustrated in FIG. 1*b*, illustrating a mattress encased with a conventional encasement, partially unzipped, supported by a foundation covered with a bed skirt in which the inflatable volume is integrated into a separate cover, shown attached to the foundation over the bed skirt, shown with the pump connected to the inflatable volume which is integrated into the bottom panel of the encasement.
Figure 37:
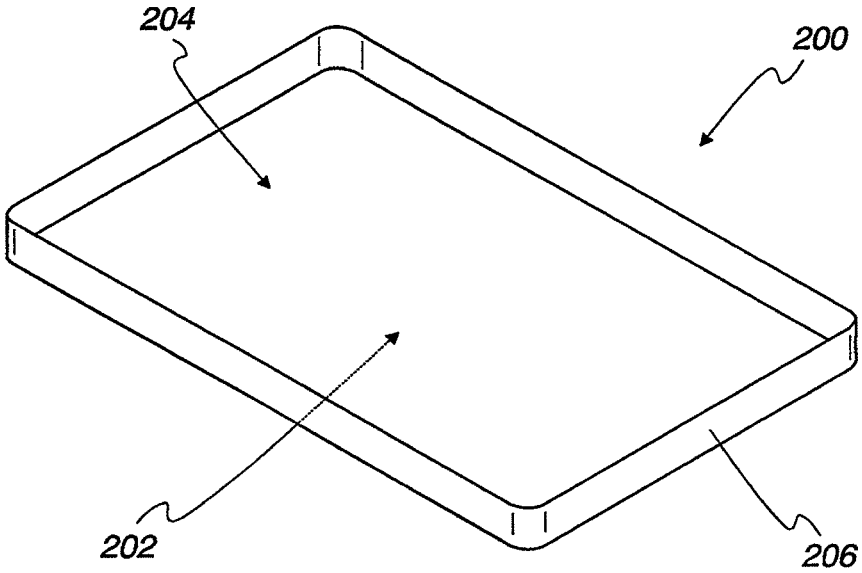
FIG. 37 is an isometric view of an optional separate cover for use with the present invention.

The first embodiment of the encasement includes an integral inflatable volume as illustrated in FIGS. 1*a*, 2, 2*a*, 3, 4, 8-11 and 29. The second embodiment of the invention is illustrated in FIGS. 1*b* and 22. FIG. 37 illustrates a separate cover which forms part of the third embodiment. In this embodiment, a separate cover, for example, an add-on device, is used with the encasement device illustrated in FIG. 1*a* providing an alternative method for rotating the mattress.

Figure 23:
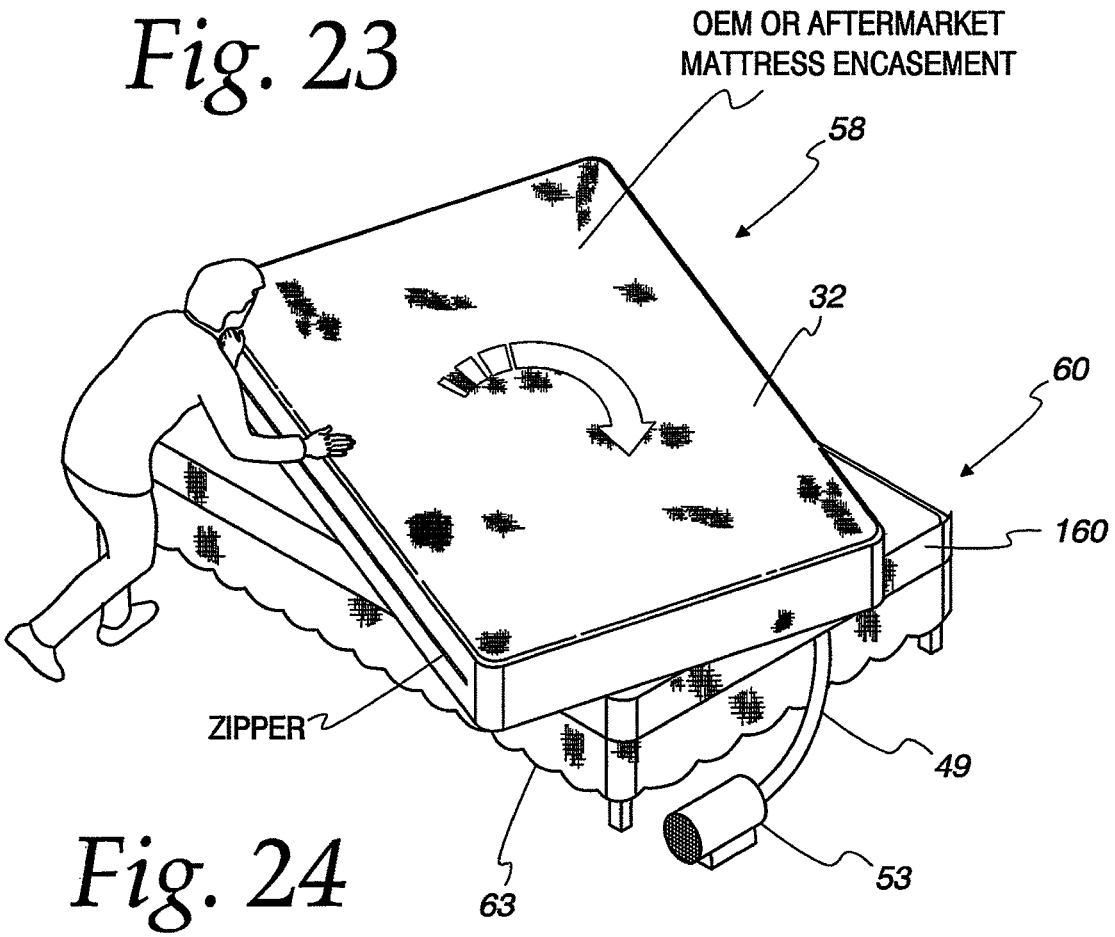
FIG. 23 is similar to FIG. 22 but illustrating the encased mattress being rotated with respect to the cover, shown with the pump connected to the inflatable volume which is integrated into the bottom panel of the encasement.
Figure 24:
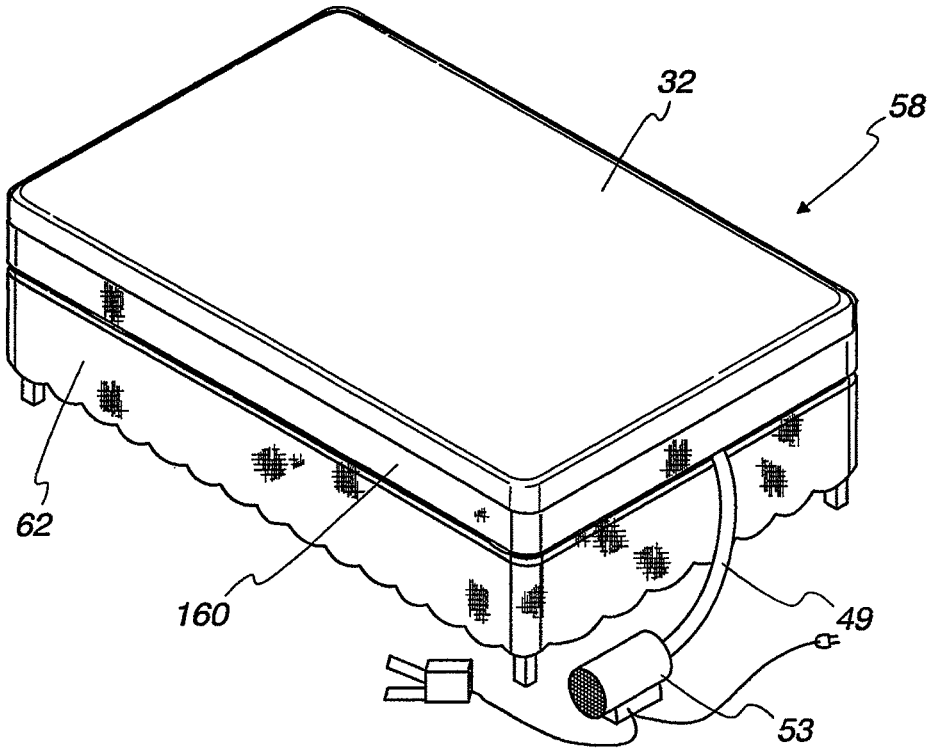
FIG. 24 is similar to FIG. 22 but shown with the cover and integrated inflatable volume attached to the mattress over the encasement, shown with the pump connected to the inflatable volume which is integrated into the bottom panel of the encasement.
Figure 25:
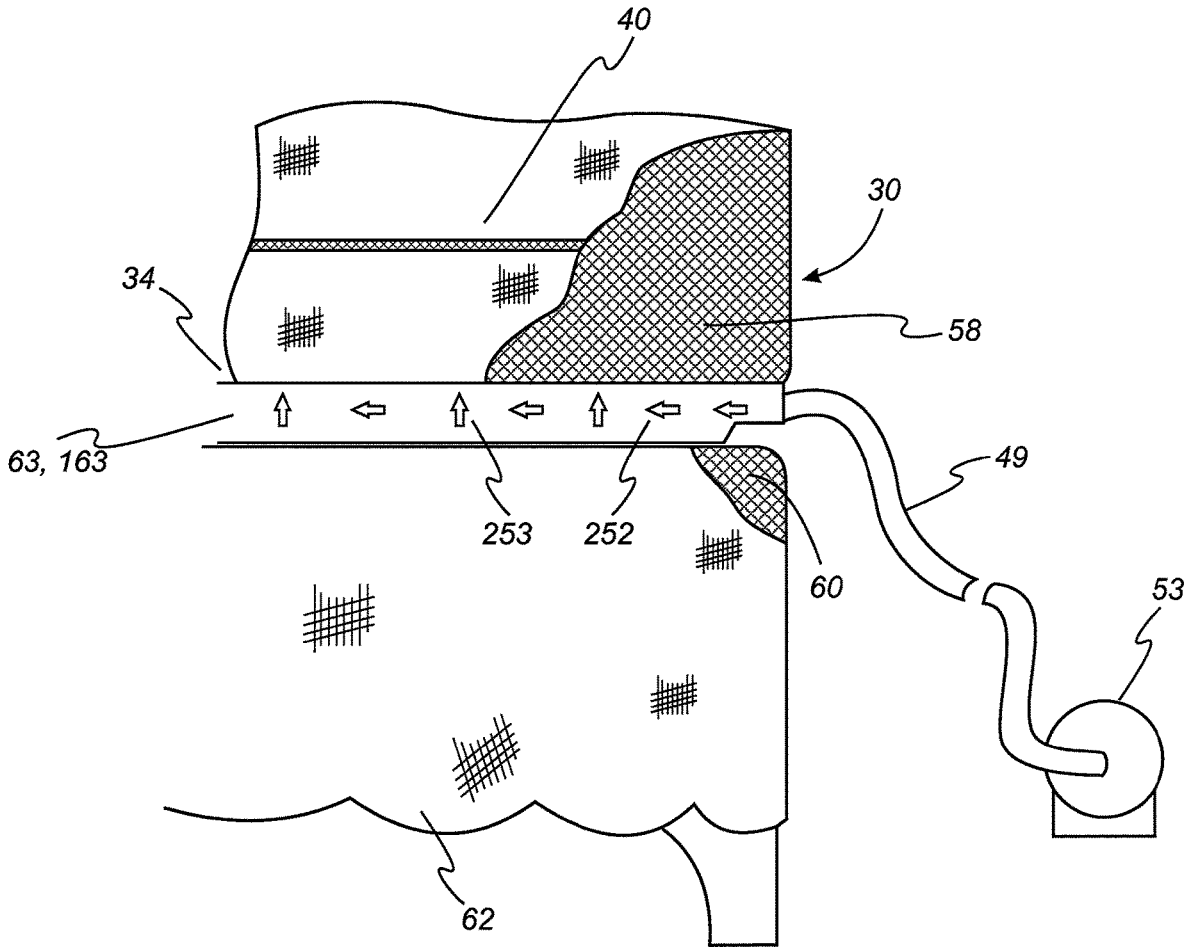
FIG. 25 is a partial sectional view illustrating the air flow when the inflatable volume is inflated.
Figure 37D:
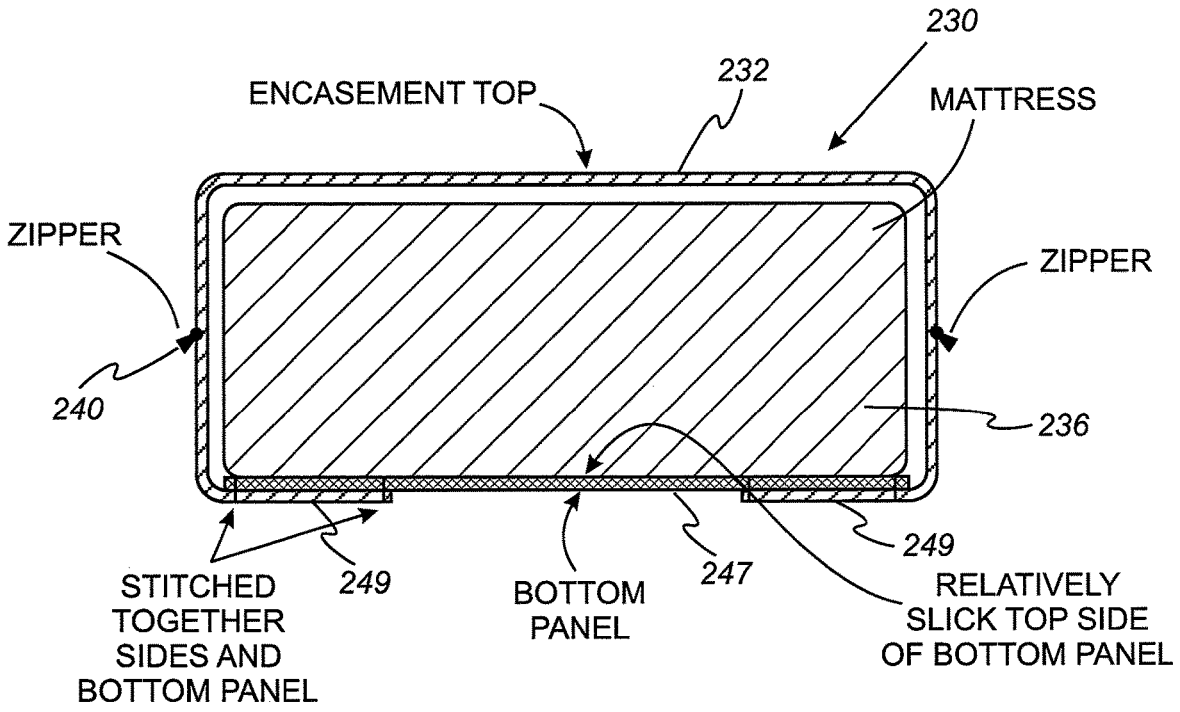
FIG. 37*d* is a cross-sectional view of an alternate embodiment of an encasement.
Figure 37E:
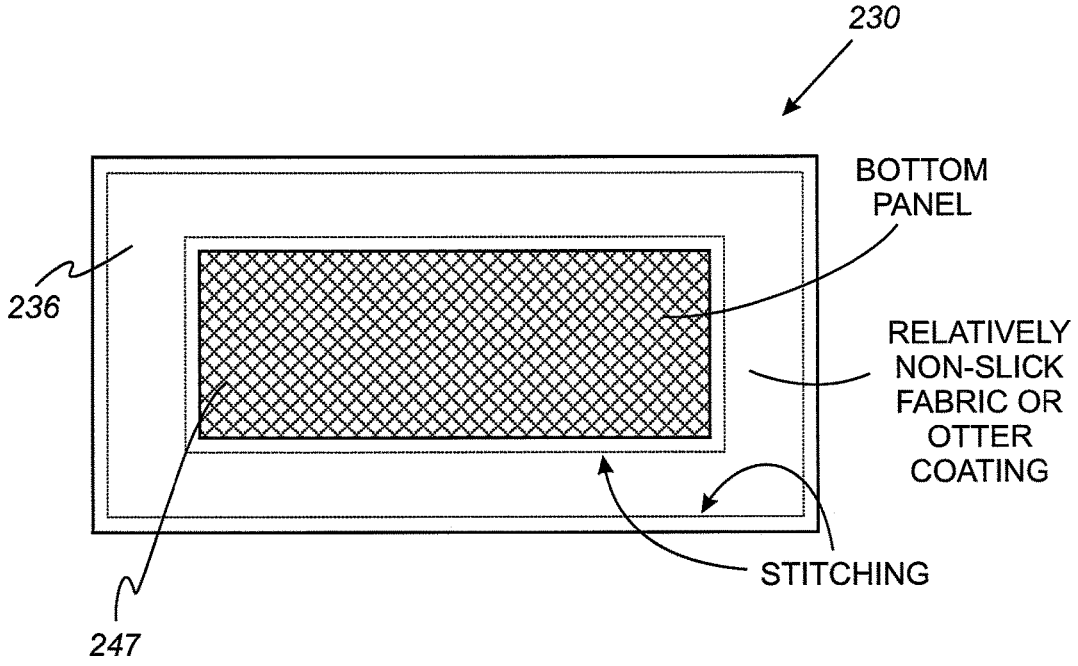
FIG. 37*e* is a bottom view of the encasement illustrated in FIG. 37*d*.
Figure 38:
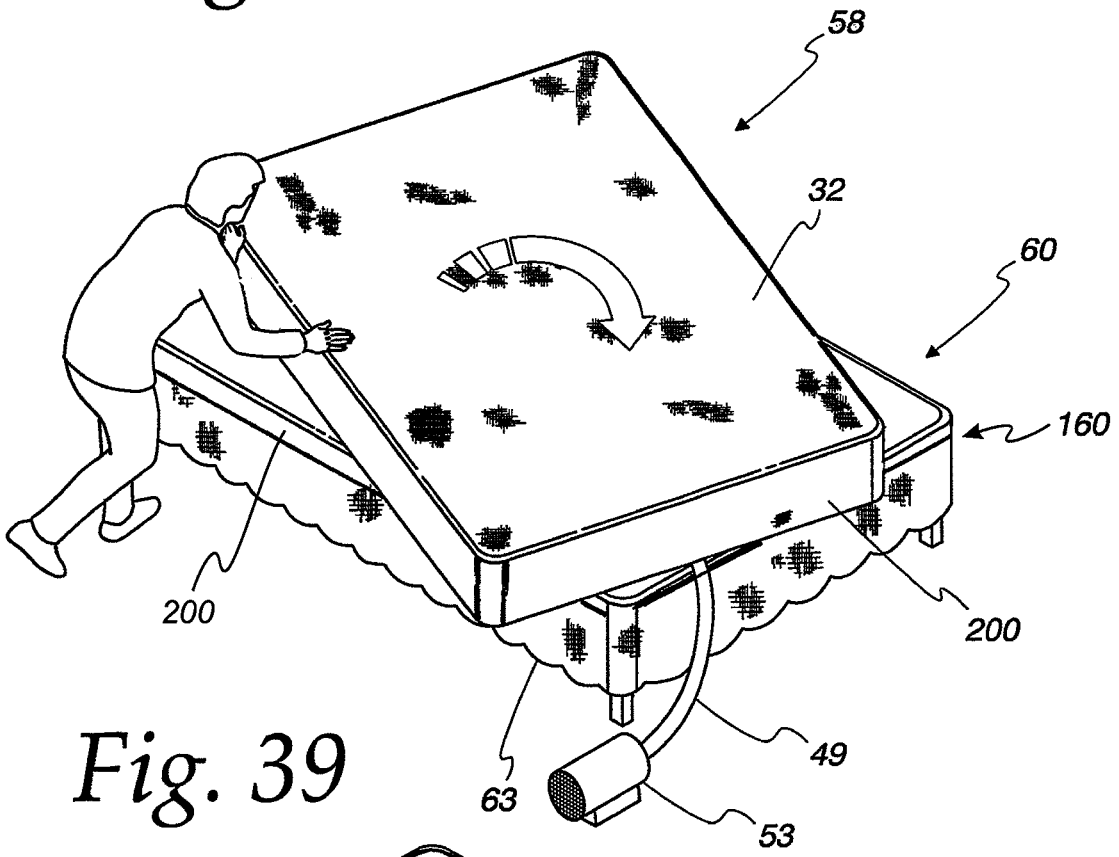
FIG. 38 is an isometric drawing of an alternative embodiment of the invention, as illustrated in FIG. 1*a* in which the encasement includes an integral inflatable volume further illustrating a separate cover as shown in FIG. 37, attached to the foundation during a rotate mode of rotation, showing the mattress partially rotated.
Figure 39:
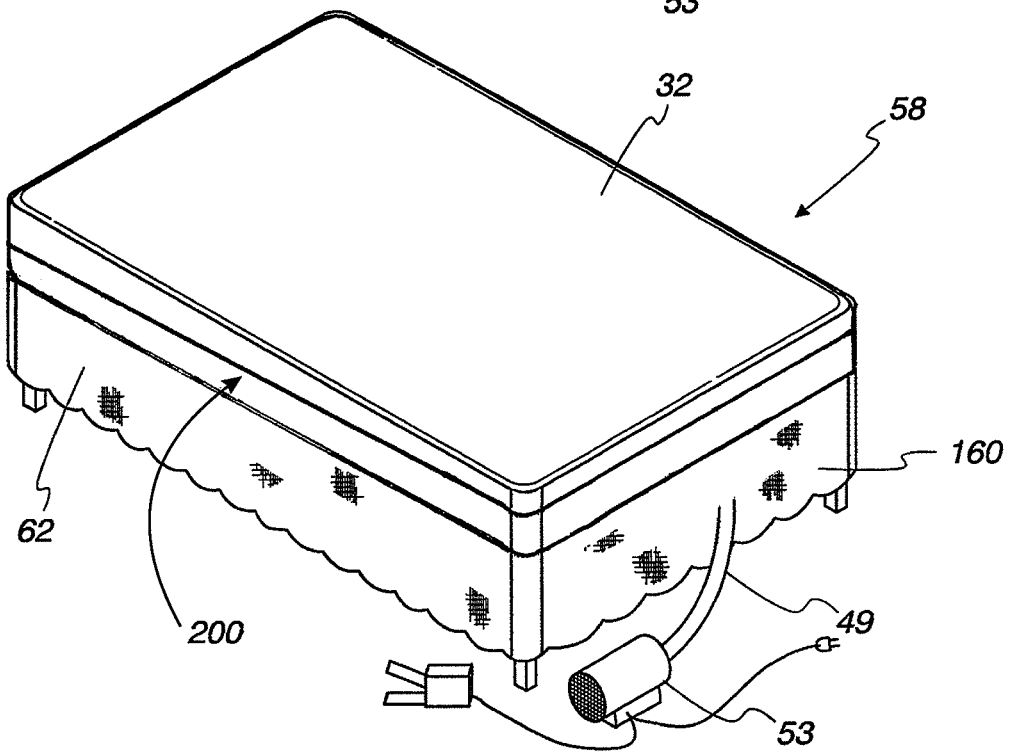
FIG. 39 is similar to FIG. 38 but illustrating the cover over the mattress and the encased mattress after being rotated with respect to the foundation, in a normal mode of operation.

FIGS. 12-17*a* illustrate the installation of a first embodiment of an encasement. FIGS. 18-21 illustrate rotation of a mattress encased with a first embodiment of the invention. FIGS. 23 and 24 illustrate rotation of a mattress in accordance with the second embodiment of the invention, illustrated in FIG. 1*b*. FIGS. 38 and 39 illustrate rotation of a mattress in accordance with the third embodiment of the invention. FIGS. 37*d* and 37*e* illustrate a fourth embodiment of the encasement.

Figure 26:
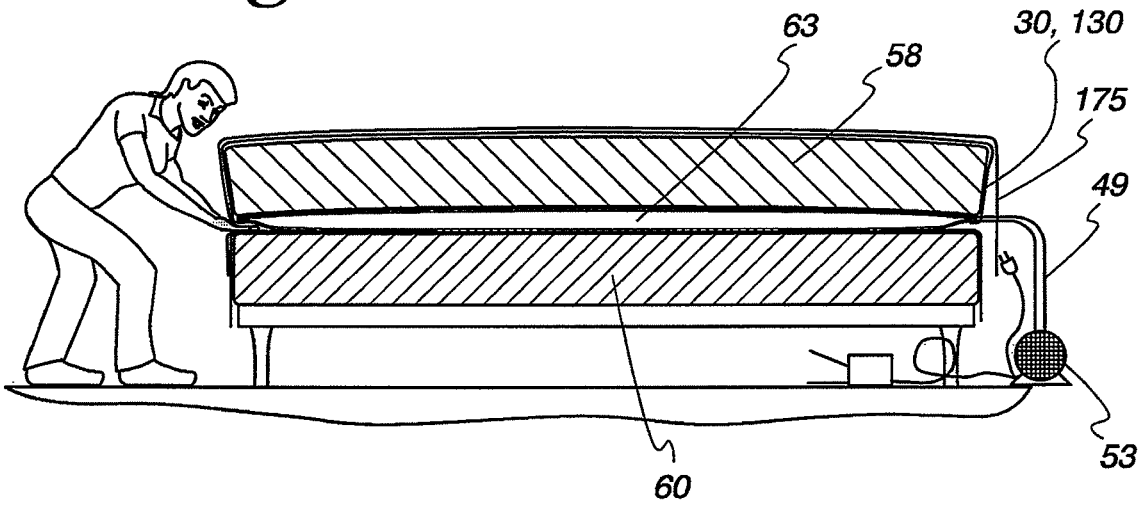
FIG. 26 is a sectional view of a mattress encased by an active encasement, shown with the inflatable volume inflated illustrating a person making a bed with flat sheets.
Figure 27:
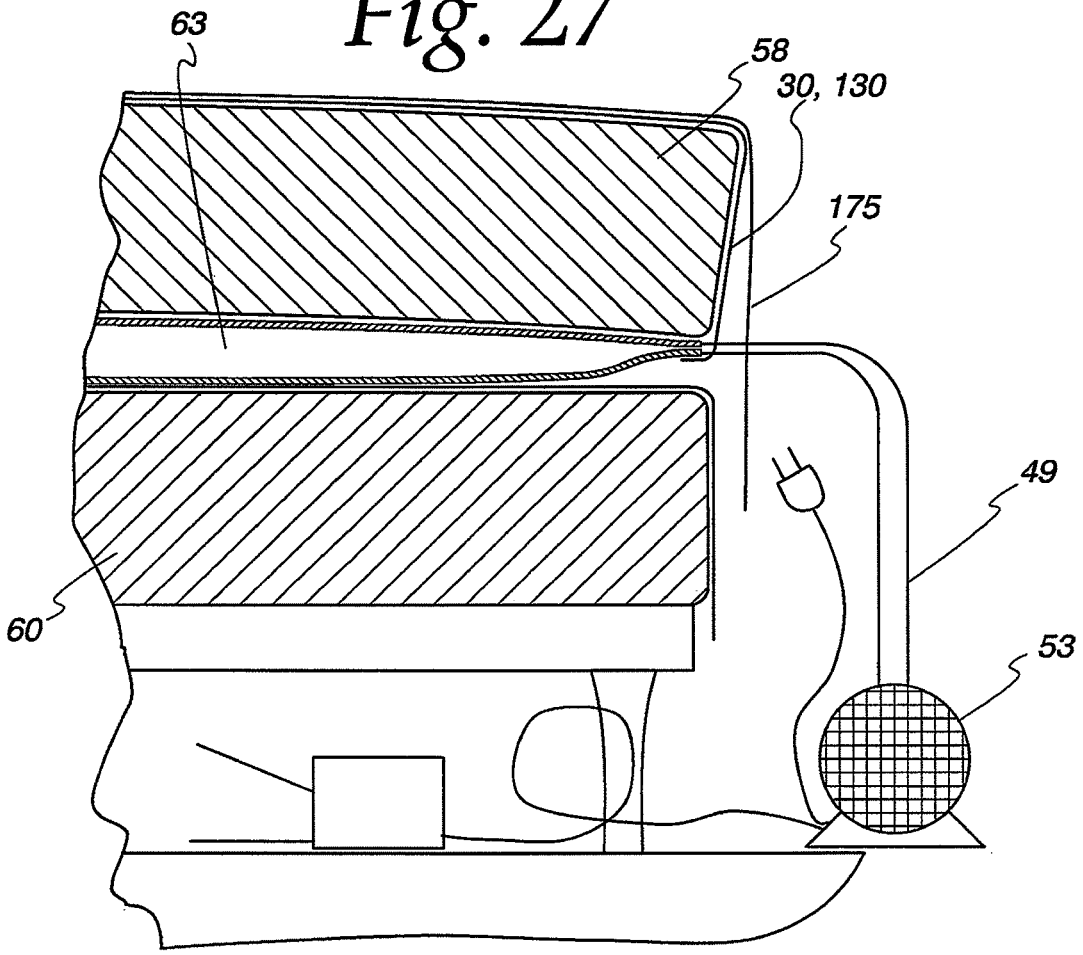
FIG. 27 is a partial sectional view of the mattress and foundation illustrated in FIG. 26, shown enlarged.
Figure 28:
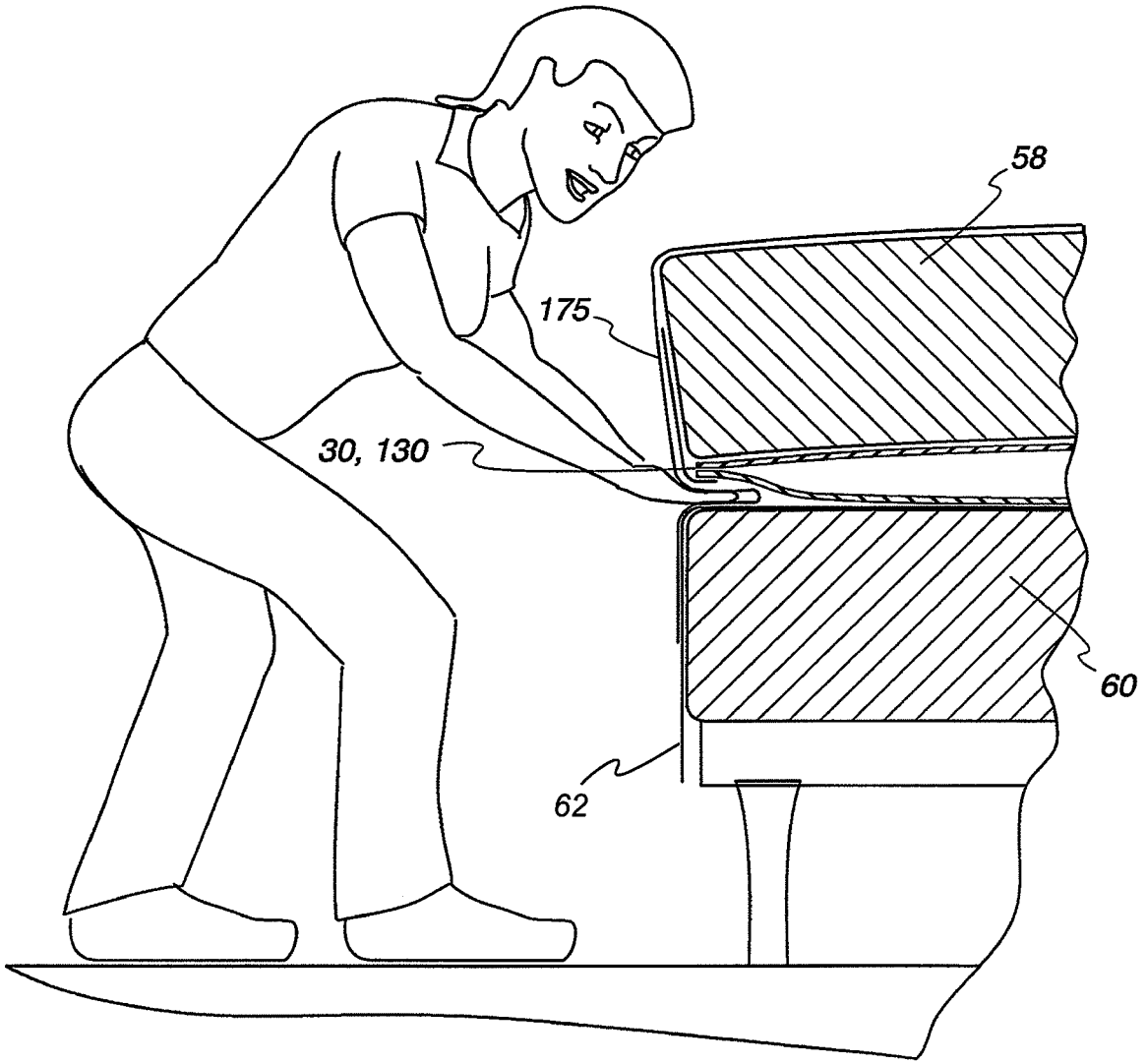
FIG. 28 is similar to FIG. 26 illustrating a portion of a flat sheet being tucked under the mattress, between the bottom surface of the inflatable volume and a bed skirt.
Figure 40:
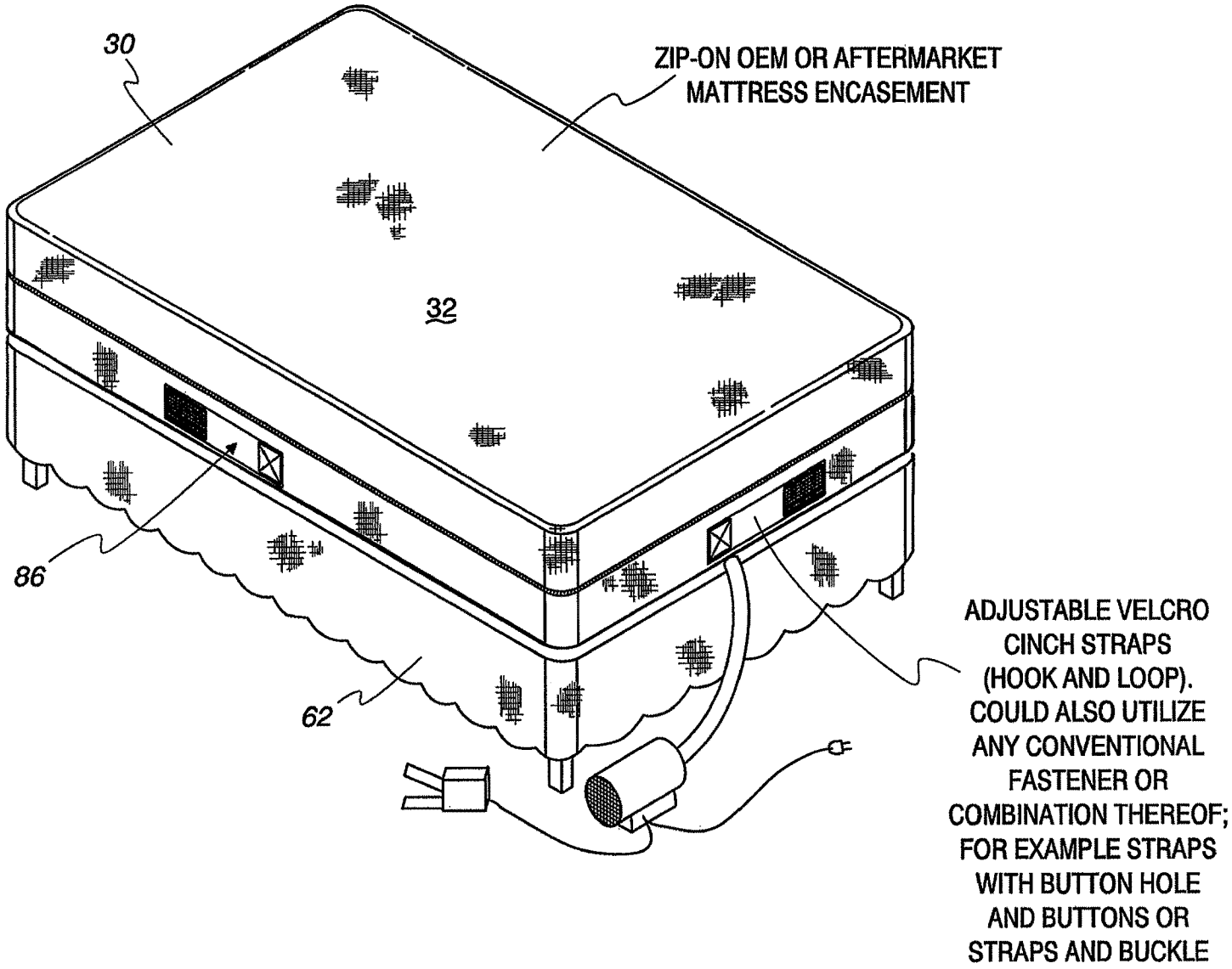
FIG. 40 is an isometric view of a bed shown with an encasement encasing a mattress illustrating optional horizontal adjustment devices to snug the encasement relative to the mattress.
Figure 41:
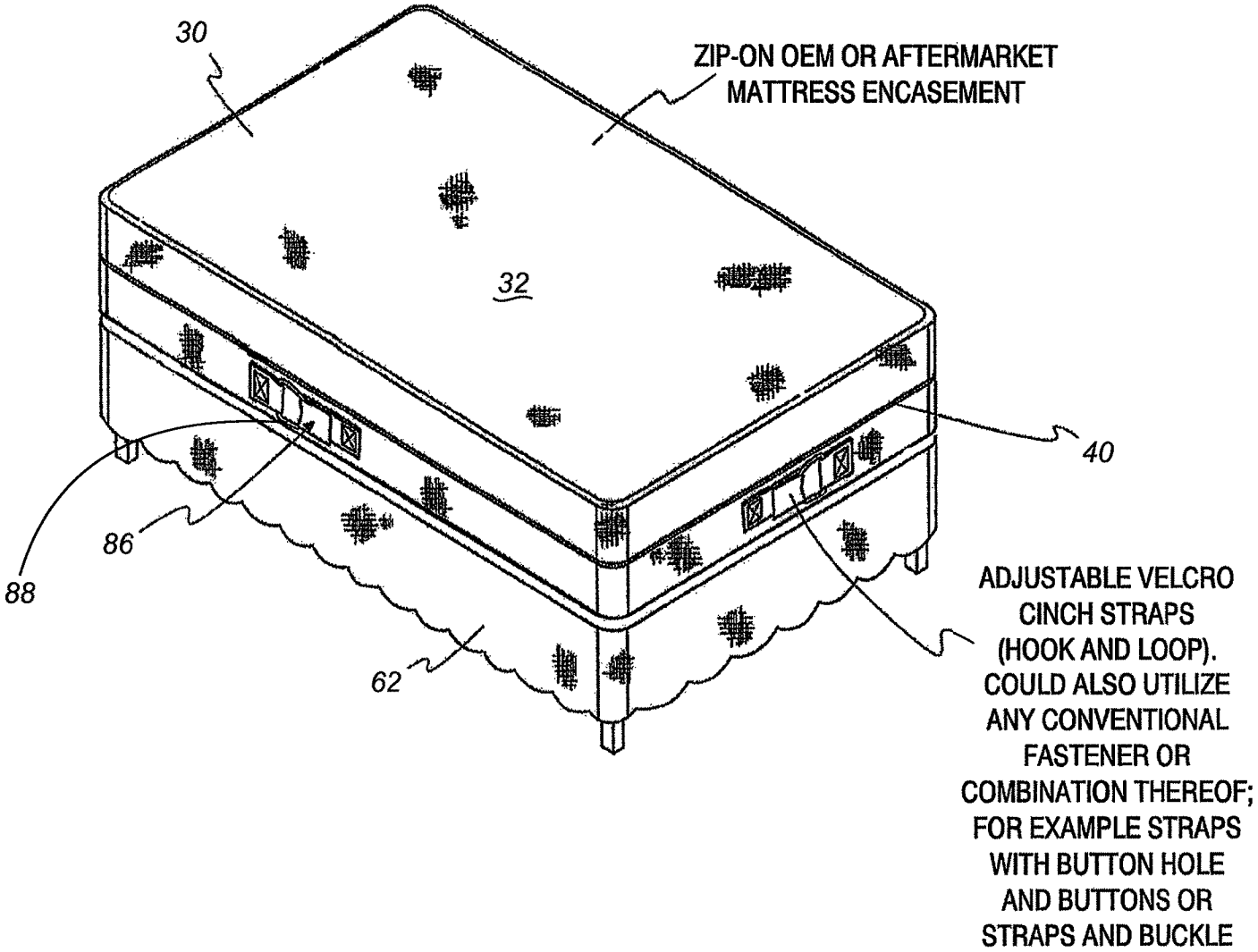
FIG. 41 is similar to FIG. 40 and illustrates an alternative embodiment of the optional horizontal device illustrated in FIG. 40.

FIGS. 26-28 illustrate the ease of bed making using the invention. FIGS. 30-36 illustrate different methods of tightening the encasement relative to the mattress in a vertical direction. FIGS. 40 and 41 illustrate tightening of an encasement relative to a mattress in a horizontal direction. FIGS. 5, 6, 7, 8*a*, 9*a* and 10*a* illustrate different techniques for controlling the air flow from the inflatable volume.

Figure 29:
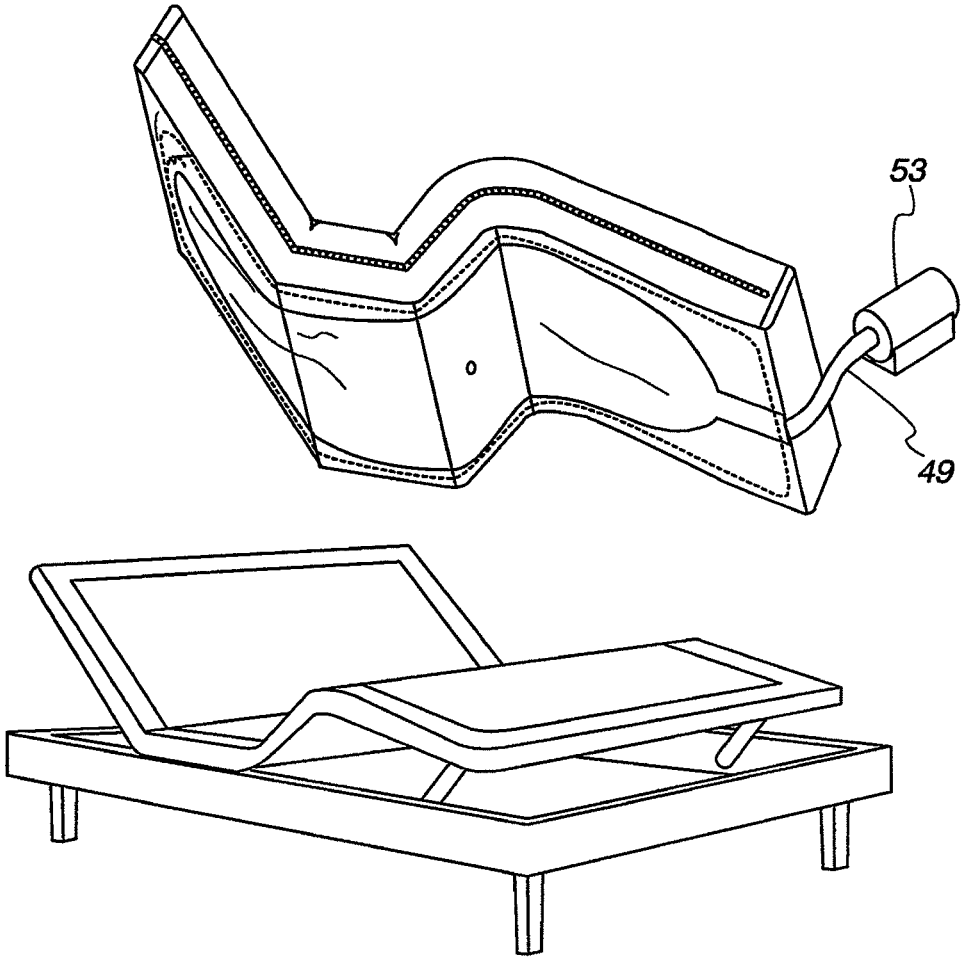
FIG. 29 is isometric view of an active encasement in accordance with the present invention, installed on a mattress carried by an adjustable platform, shown with the encased mattress removed from the foundation.

The principles of the present invention are applicable to various mattresses including box springs and mattresses supported by fixed foundations, such as box springs, as well as adjustable platforms, as illustrated in FIG. 29. As shown in FIG. 29, for example, the air pump 53 and conduit 49 are attached on one end of the encasement. However it is to be understood that the nozzle and air pump can be connected anywhere on the inflatable volume.

Figure 1B:
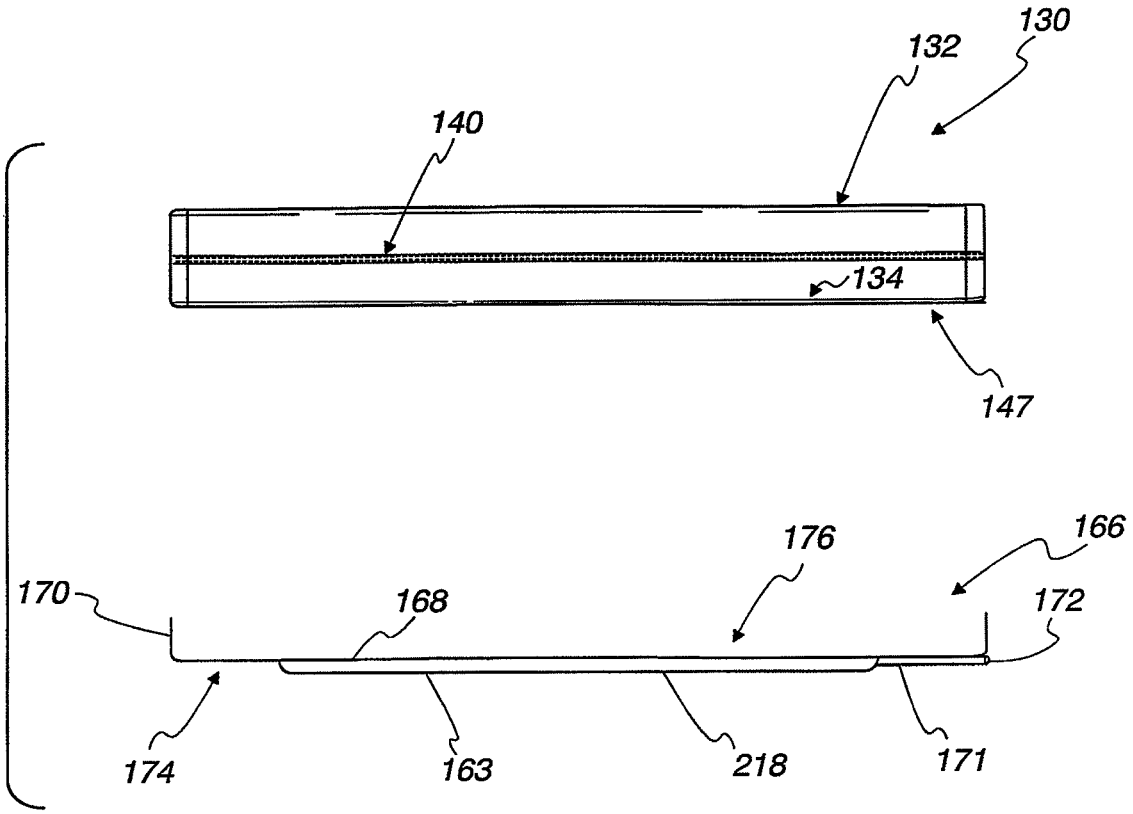
FIG. 1*b* is similar to FIG. 1*a* but illustrating an alternative embodiment in which the inflatable volume is integrated into a separate cover that may be attached and detached from an encasement by conventional techniques.
Figure 1C:
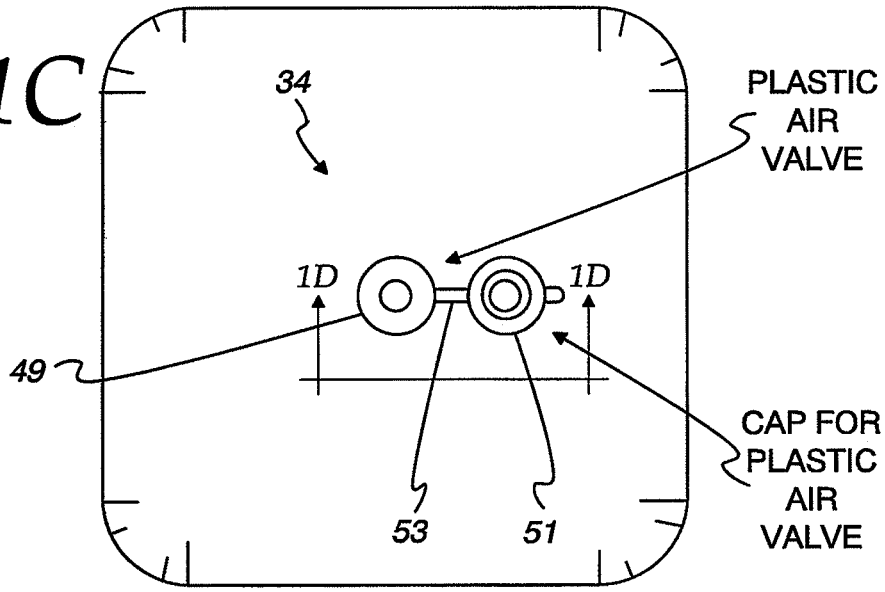
FIG. 1*c* is a bottom view of the encasement shown in FIG. 1*a* illustrating an optional air valve with an optional cap integrally formed in a bottom panel of the encasement.
Figure 1D:
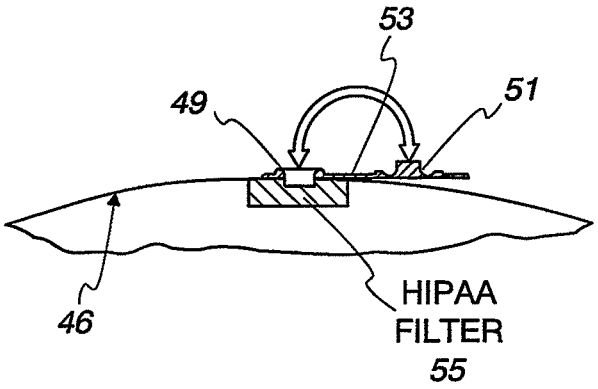
FIG. 1*d* is a section view of the encasement illustrated in FIG. 1*a* illustrating an optional filter, such as a HEPA filter, attached to an interior or exterior surface of the encasement for filtering air into and out of the encasement.

FIGS. 1*c* and 1*d* illustrate optional features of the invention that may be incorporated into the encasements in the various embodiments of the invention, discussed above. Specifically, an optional air valve, such as a conventional valve, for example, a conventional plastic air valve 49 with an optional cap 51 attached thereto with a strap 53, may be integrated into the encasement 30. Specifically, the air valve 49 may be attached anywhere on the encasement 30 except for the inflatable volume. For example, plastic valve may be attached to the top panel 32 or bottom panel 34 or one of the side panels 36 or 38. The plastic valve 49 facilitates removing air from the encasement 30 so that the encasement 30 can be packed for travel for use on hotel and motel mattresses. The plastic valve 49 allows air to be removed to minimize the space the encasement 30 will take in a suitcase or travel bag. The air may be removed manually or mechanically, for example, by way of a vacuum cleaner.

After the encasement 30 is used on a hotel or motel mattress, it is preferable to zip up the encasement 30, remove the air, as discussed above, and transport the encasement in a zipped up condition until the encasement can be laundered. This is done to prevent mites, bed bugs, allergens, certain microbes, and the like from the hotel or motel mattress from being released in a suitcase or travel bag. A HEPA filter 55 (FIG. 1*d*) may be fixedly attached to an interior or exterior surface of the encasement 30, for example, the surface 46 as shown in FIG. 1*d*, to cover the airway of the valve 49 to prevent bed bugs or dust mites or bacteria or allergens picked up from the hotel or motel mattress from escaping through the air valve 49.

Alternatively, the air valve can be omitted and a small aperture formed anywhere on the encasement covered with a HEPA filter may be used. The HEPA filter 55 can also be used with the various adjustable air valves, for example, the air discharge valves 83 and 85, as illustrated in FIGS. 9*a* and 9*b*, as well as the air exit holes 67, illustrated in FIGS. 3 and 4, for example.

First Embodiment

As mentioned above, a first embodiment of the invention which includes an integrally formed inflatable volume is illustrated in FIGS. 1*a*, 2, 2*a*, 3, 4, 8-10, 11, and 29. Referring first to FIG. 1*a*, the active encasement in accordance with the present invention is shown and identified with the reference numeral 30. The encasement includes a top panel 32, a bottom panel 34 and four side panels, generally referred to with the reference numeral 36. One or more of the four side panels 36 include a zipper 40 or other conventional attachment means which define an upper side panel portion 42 and a lower side panel portion 44. In embodiments in which one, two or three side panels are zippered, the un-zippered side panel 38 may be formed as a single piece and connects the top panel 32 to the bottom panel 34 on the one side.

Figure 1E:
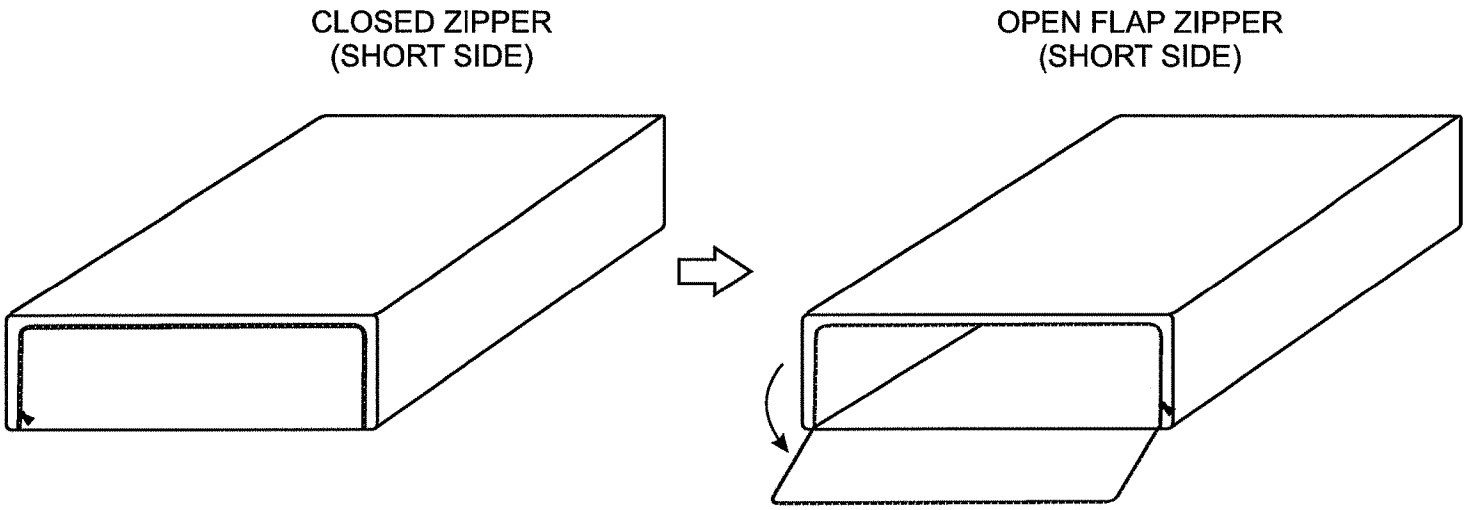
FIG. 1*e* is an alternate embodiment of the invention in which a zipper is disposed in a short side panel on one end along three (3) edges of the side panel, illustrating the encasement zipped and unzipped.
Figure 1F:
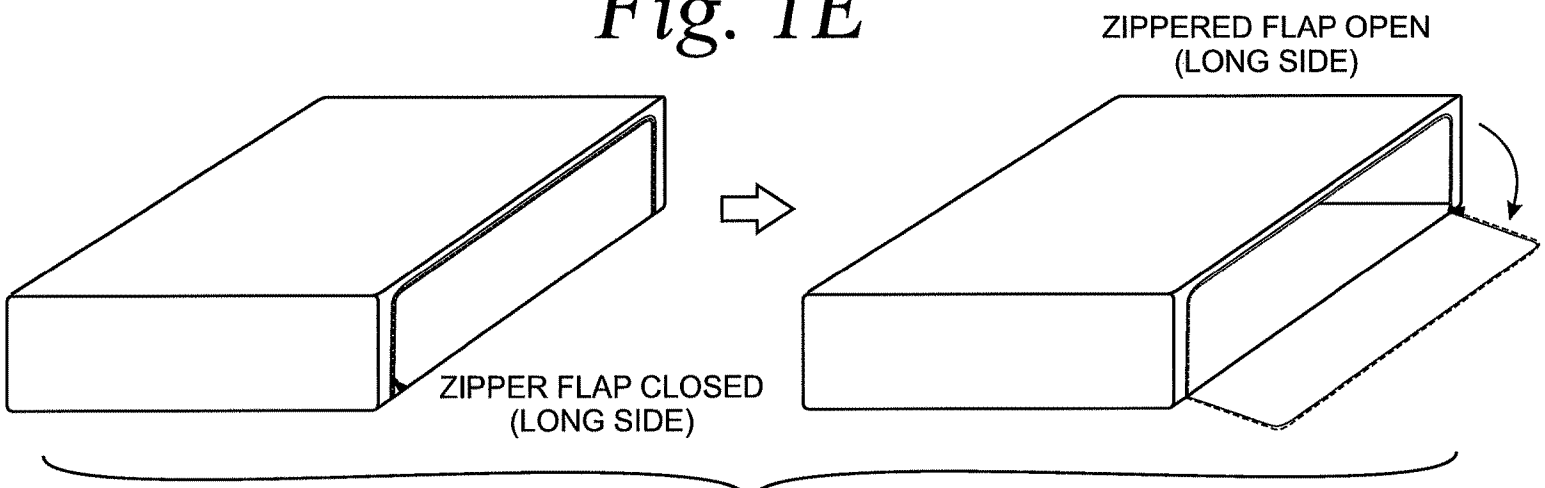
FIG. 1*f* is similar to FIG. 1*e* but illustrating a zipper on a long side panel.

Alternatively, only one side panel of the encasement may be zippered, as illustrated in FIGS. 1*e* and 1*f*. Referring first to FIG. 1*d*, an embodiment is illustrated in which a short side panel of the encasement is zippered. FIG. 1*f* illustrates an embodiment in which a long side panel is zippered.

Referring back to FIG. 1*a*, the top and bottom panels 32 and 34 are generally rectangular in shape and are configured to fit the length and width of standard bed sizes. US standard mattress sizes are provided below in Table 1. It is to be noted that the principles of the invention are also applicable to non-US mattress sizes, as well as non-standard sizes. As will be discussed below, the principles of the invention also apply to mattresses having different depths, even so-called "deep pocket" mattresses.

TABLE 1

US Standard Mattress Sizes

| Common Term | Length × width dimension in inches | Length × width dimension in centimeters |
|---|---|---|
| Twin | 39 × 75 | 99 × 190 |
| X-Long Twin | 39 × 80 | 99 × 203 |
| Full | 54 × 75 | 137 × 190 |
| Queen | 60 × 80 | 153 × 203 |

TABLE 1-continued

US Standard Mattress Sizes

| Common Term | Length × width dimension in inches | Length × width dimension in centimeters |
|---|---|---|
| King | 76 × 80 | 198 × 203 |
| California King | 72 × 84 | 182 × 213 |

The encasement 30 in accordance with the present invention provides the standard protection for a mattress from spills, allergens, parasites and/or stains but also provides additional features which relate to the management of the mattress, as discussed below. These features are provided by the novel construction of the encasement 30, as discussed below.

The bottom panel 34 is configured to facilitate various mattress management features without compromising the ability of the encasement 30 to provide protection from stains and parasites. Specifically, the bottom panel 34 includes an interior surface 46 and an exterior surface 48. The interior surface 46 is formed as a slick surface while the exterior surface 48 is formed with an integrally formed inflatable volume, generally identified with the reference numeral 48 from an at least partially non-slick material, generally identified with the reference numeral 47. In the first embodiment the non-slick material 47 helps provide a frictional grip between the encasement and the foundation or bed skirt while the mattress is being rotated and during installation or removal of the encasement, as discussed below.

Various materials can be used for the bottom panel 34 having a slick interior surface 46 and the non-slick material 47. All of these materials including the materials used for the balance of the encasement 30 may be launderable. As used herein, the terms "slick" and "non-slick" refer to their respective relative co-efficient of friction. In other words, the present invention contemplates materials in which the "slick" surface has a relatively lower co-efficient of friction than the "non-slick" surface. Exemplary materials are provided below. As used herein, the materials and or coatings may be formed as a single layer or multiple layers.

The non-slick exterior material 47 of the bottom panel can be created on one side of a slick material by way of a coating or sewing or fusing a non-slick backing to one side of the non-slick material. Other conventionally available materials are also suitable for the bottom panel 34 having a slick interior surface 46 and a non-slick exterior material 47. For example, 70 Denier Heat Sealable (backside) 100% Nylon Rip Stop material is suitable for use for the bottom panel 34 other materials with similar coefficients of friction with a coating on one side, for example, urethane, silicone, or coated or bonded or sewn or fused thermal plastic or heat sealable coatings. Alternatively, a non-slick material can be used for the bottom panel 47 with a slick coating or a fabric with a slick side and a non-slick side.

Such nylon or polyester rip stop material is known to come in widths of 32"-104" inches wide and weigh about 0.9-4.4 ounces per square yard. Such material can easily be pieced together to accommodate various mattress widths if necessary. Nylon or polyester rip stop material suitable for use with the present invention is available from various sources, such as, Quest Outfitters of Sarasota, Fla. (http:/questouffitters.com). Their nylon taffeta material is described in detail at http:/questouffitters.com/coated.html#HEAT SEALABLE, hereby incorporated by reference. Suitable nylon or polyester taffeta material is also available from Rockywoods in Loveland, Colo. (http:/www.rockywoods.com). Their nylon taffeta material is described in detail at http:/wvvw.rockwoods.com/Fabrics-Hardware-Patterns-Kits/Medium-Weight-Nylon-Fabrics/Heat-Sealable-70-Denier-Nylon-Taffeta, hereby incorporated by reference.

Non-woven materials may also be used for the bottom panel 34 having a slick side and a non-slick side. For example, Tyvek® polyethylene non-woven fabric, as manufactured by the DuPont Corporation and described in detail at http:/www2.dupont.com/Products and Services/en VN/nwn.html may be used. Other materials having two slick sides can also be used, such as, silicone impregnated nylon rip stop, for example, as available from Seattle Fabrics, Inc., http:/www.seattlefabrics.com/nylons.html. Other materials can also be used with a coating applied to one side. Moreover, different materials can be used for each cover in an application.

Various other materials with a slick side and a non-slick side are also suitable for the bottom panel 34. For example, the following exemplary materials may be used:

- warp-knit fabric with a polyurethane laminate coating or a silicone coating.
- a non-woven material with a polyurethane laminate coating or a silicone coating.
- Tricot fabric with a polyurethane backing or a silicone coating
- neoprene fabric with a polyurethane backing or a silicone coating.
- ballistic nylon or polyester fabric with polyurethane backing or a silicone coating.
- polyester knit fabric with a polyurethane backing or a silicone coating.
- cotton/polyester terry fabric with a polyurethane backing or a silicone coating.
- jacquard knit fabric with a polyurethane backing or a silicone coating.
- coral fleece fabric with a polyurethane backing or a silicone coating.
- microfiber/polyester knit with polyurethane backing or a silicone coating.
- a stitch bond fabric with a polyurethane laminate coating or a silicone coating.
- nylon or polyester rip stop with a silicone coating on one side and a polyurethane coating on the other side
- typical nylon or polyester ripstop with a silicone coating on one side and a polyurethane coating on the other side
- woven or non-woven fiberglass fabric with a silicone coating on one side and a polyurethane coating on the other side
- a stitch bond fabric, available from Tietex, item no 944164, style no. C243, wherein the fabric is 32% rayon, 22% polyester, 6% twaron and 40% coat.
- calendared nylon or polyester rip stop with a silicone coating on one side and a polyurethane coating on the other side
- calendared nylon or polyester taffeta with a silicone coating on one side and a polyurethane coating on the other side
- calendared suitable fabric with a silicone coating on one side and a polyurethane coating on the other side Materials having a similar co-efficient of friction may also be used. All such materials are considered to be within the broad scope of the invention.

The following textile materials may also be used for the various surfaces discussed above. These textile materials can be used uncoated or coated on one or both sides as indicated below to control the co-efficient of friction to create a slick surface or a non-slick surface relative to the co-efficient of friction on the opposite side.

70 DENIER×70 DENIER NYLON RIPSTOP
70 DENIER×70 DENIER POLYESTER RIPSTOP
70 DENIER NYLON & POLYESTER BLEND
70 DENIER NYLON TAFFETA
70 DENIER POLYESTER TAFFETA
30 DENIER POLYESTER OR NYLON RIPSTOP OR TAFFETA
210 DENIER OXFORD NYLON
210 DENIER OXFORM POLYESTER
210 DENIER NYLON & POLYESTER BLEND
NEOPRENE
BALLISTIC NYLON OR POLYESTER OR POLYESTER BLEND
WARP-KNIT FABRIC
POLYVINYL CHLORIDE (PVC)
POLYETHELENE SHEETING
POLYPROPOLENE SHEETING
NON-WOVEN FABRIC
OLEFIN
POLYOLEFIN
POLYETHYLENE (PE, LLDPE, HDPE)
STITCH-BOND FABRIC
COTTON BLEND
TERRY MATERIAL
TRICOT
NYLON COATED MATERIAL
POLYESTER COATED MATERIAL
PRESSURE SENSITIVE BACKED MATERIAL
LAMINATED MATERIAL
HIGH DENSITY & MOLECULAR WEIGHT POLYETHELYNE FILM
POLYETHYLENE VINYL ACETATE

The following materials may be coated, laminated, bonded, impregnated, embossed, fused, layered between, or backed onto a side of the textile material(s) to provide a relatively high co-efficient of friction and thus may be used to provide a relatively non-slick surface, relative to the opposite side.

POLYURETHANE
POLYVINYL CHOLRIDE (PVC)
POLYETHYLENE VINYL ACETATE
THERMO PLASTIC
RUBBER
HEAT SEALABLE
WATER REPELENT
ACRYLIC
ADHESIVE
BLENDED COATING OF ANY OF THE ABOVE
UNCOATED or utilizing the inherently low friction coefficient of an uncoated fabric
FOAM
SILICONE
BLENDED POLYMER
NYLON
POLYESTER
THEMOPLASTICS ELASTOMER (TPE)

The following materials may be coated, laminated, bonded, impregnated, embossed, fused, layered between, or backed onto a side of the textile material(s) to provide a relatively low co-efficient of friction and thus may be used to provide a relatively slick surface, relative to the opposite side.

SILICONE
TEFLON
PETROLEUM BASE
POLYURETHANE
DIRT WEAR RESISTENT
HEAT SEALABLE
BLENDED COATING OF ANY OF THE ABOVE
SLICK FIBER WOVEN INTO FABRIC
UNCOATED or utilizing the inherently low friction coefficient of an uncoated fabric
BLENDED POLYMERS
NYLON
POLYESTER
THERMOPLASTIC ELASTOMER
POLYETHYLENE VINYL ACETATE The top panel 32 defines an interior surface 52 and an exterior surface 50. The interior surface 52 is formed with a waterproof coating or membrane, for example, polyurethane or other conventional waterproof coating. The exterior surface 50 is formed from cotton or other common encasement material or a material commonly used for mattress protectors, as well as conventional bedding or launderable material, such as polyester or a polyester-cotton. The waterproof membrane may be coated on one side of the upper panel 32.

Various other materials can be used which are waterproof and/or spill proof and/or, moisture proof and/or anti-bacterial and/or anti-allergen and/or anti-microbial and/or anti-mite and/or bed bug proof. For example, a bamboo knit fabric with a TPU or PU lamination. Bamboo is naturally occurring anti-bacterial material. The TPU or PU lamination provides waterproofing and anti-allergen, anti-dust-mite, and anti-bed bug protection. Other fabrics with a nano-silver finish with a TPU or PU coating. The nano-silver finish is an non-allergic material. These materials can be used alone or in combination with other materials disclosed herein.

Various configurations for the side panels 36 and 38 are contemplated. For example, the side panels 36 and 38 may be formed from the same material as the bottom panel 34 or the top panel 32 or alternatively from other materials, such as permanent conventional or non-conventional bedding materials, for providing stain and/or allergen and/or parasite protection. The side panel 38 may be integrally formed with the top panel 32 and/or the bottom panel 34 or attached thereto by permanent conventional and/or non-conventional means, such as by sewing and/or RF welding and/or heat sealing and/or dielectric sealing and/or welding and/or ultrasonic sealing and/or heat sealing and/or bonding and/or utilizing adhesive and/or or weaving. The split side panels 36 may be formed from the same material as the bottom panel 34 or top panel 32. The side panels 36 are formed with an upper portion 42 and a lower portion 44 that are joined together by a zipper 40. The upper and lower portions 42 and 44, respectively, may be formed as a continuous strip that serves one or more side panels 36. The upper portions are attached to the top panel 32 by permanent conventional means, such as by sewing and/or RF welding and/or heat sealing and/or dielectric sealing and/or welding and/or ultrasonic sealing and/or heat sealing and/or bonding and/or utilizing adhesive and/or or weaving. The lower portion is similarly attached to the bottom panel 34. The upper and lower portions 44 and 42, respectively, may be formed as part of the upper and lower panels 32 and 34, respectively. The zipper 40 may be attached to the upper portion 42 and the lower portion 44 of the side panels 36 by permanent conventional means, such as sewing and/or RF welding and/or heat sealing and/or dielectric sealing and/or welding and/or ultrasonic sealing and/or heat sealing and/or bonding and/or utilizing adhesive and/or or weaving.

Figure 2:
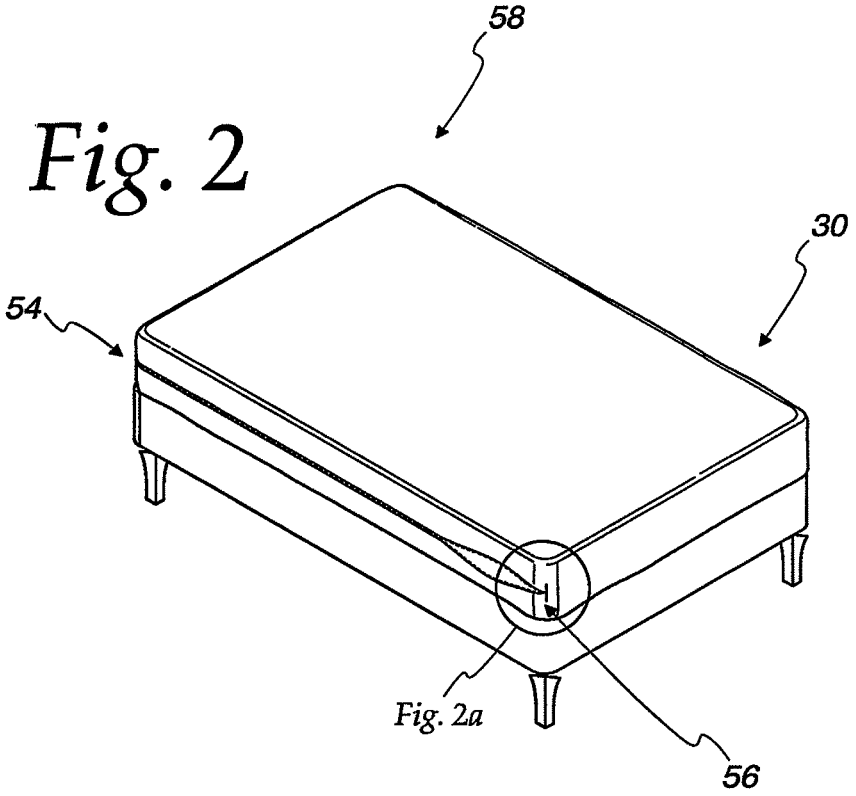
FIG. 2 is an isometric view of mattress supported by a foundation in which the mattress is covered with an encasement, shown with the encasement partially unzipped at one end.
Figure 2A:
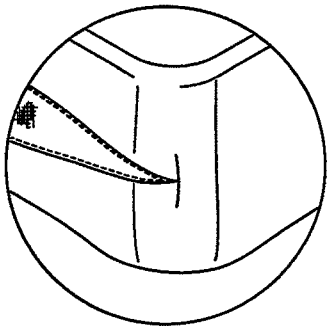
FIG. 2*a* is an enlarged partial view of one corner of the mattress illustrated in FIG. 2.

In order to facilitate installation of the encasement 30 on a mattress or foundation, a zipper 40 is provided from corner to corner, for example, on each of the zippered sides 36. The zipper 40 may be a conventional zipper that extends from one corner 54 on one side to the corner 56 on the third side, as illustrated in FIGS. 2 and 2*a*. The zipper 40 may be attached to the sides 36 by permanent conventional and/or non-conventional means, such as by sewing and/or RF welding and/or heat sealing and/or dielectric sealing and/or welding and/or ultrasonic sealing and/or heat sealing and/or bonding and/or utilizing adhesive and/or or weaving and/or. As will be discussed in more detail below, the configuration of the zipper 40 facilitates installation of the encasement and also facilitates rotation of the mattress. As mentioned above, the upper and lower panels may be oversized and used without discrete side panels.

Figure 3:
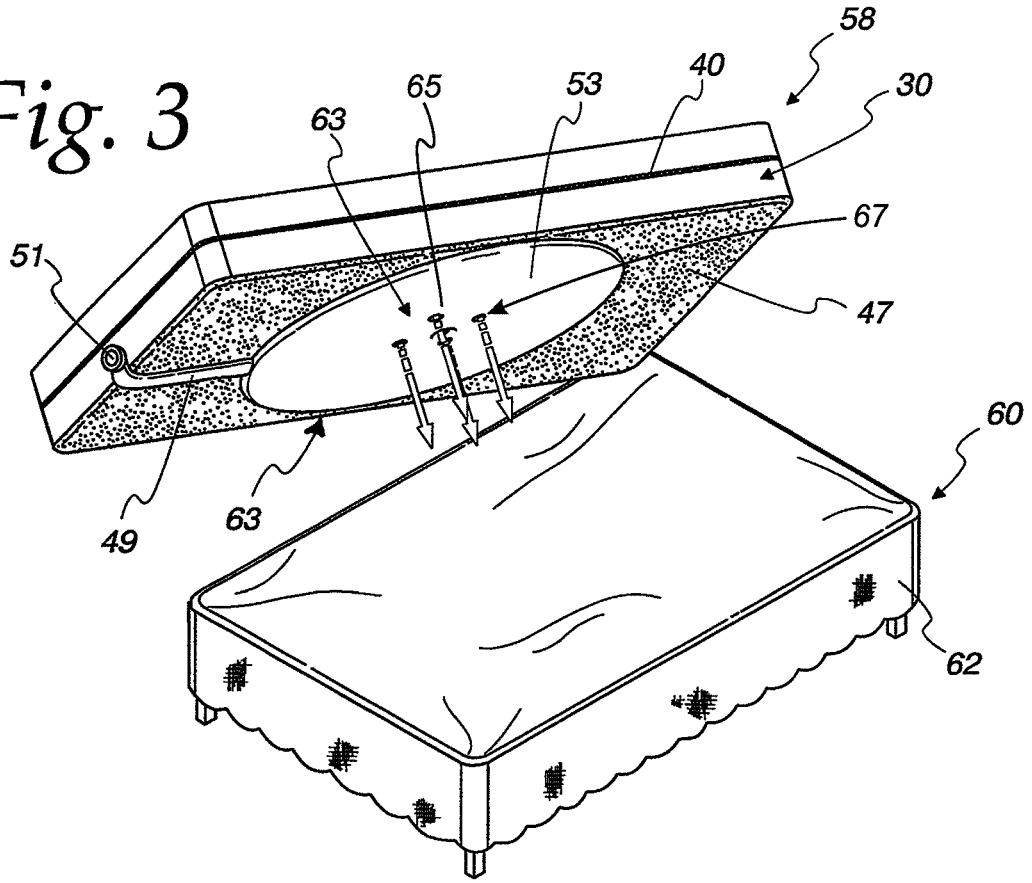
FIG. 3 is an isometric view of a mattress covered with an active encasement with an integrated inflatable volume with a plurality of air discharge holes and an attachment point, shown with a bed skirt covering the foundation and with the encased mattress removed from the foundation.
Figure 4:
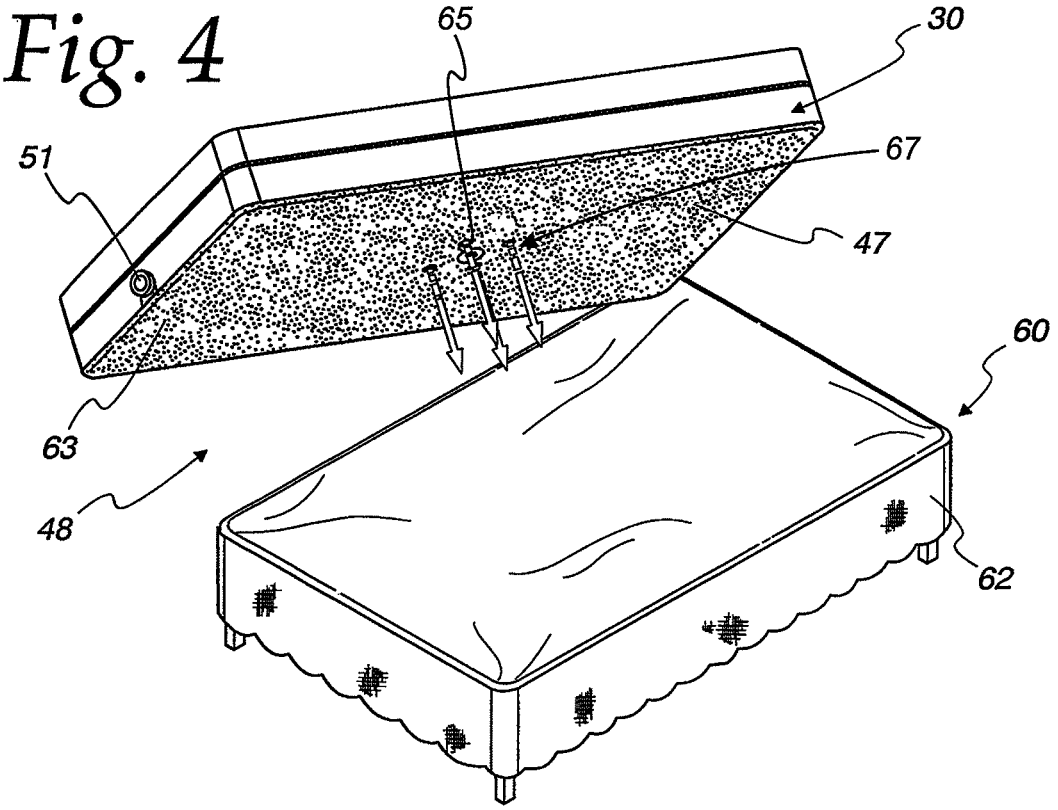
FIG. 4 is similar to FIG. 3 except illustrating an alternative embodiment of the encasement.
Figure 11:
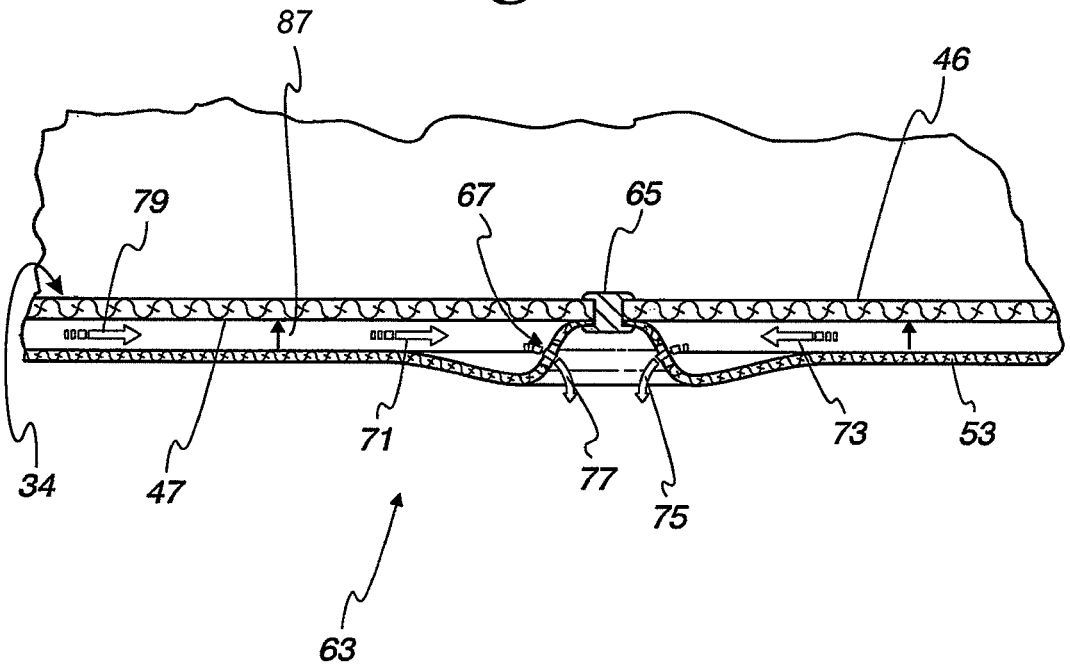
FIG. 11 is a partial sectional view of an active encasement with an inflatable volume with a center attachment point and air exit holes as illustrated in FIGS. 3 and 4, which illustrates the air flow into the inflatable volume which provides the lift.

FIGS. 3 and 4 illustrate a mattress encased with different embodiments of an active encasement with an integral inflatable volume 63. Both embodiments illustrate an encased mattress 30 removed from a foundation 60 covered by a bed skirt 62. The inflatable volume 63 may be configured in various shapes and may include a conduit 49 and an air inlet nozzle 51. The air inlet nozzle 51 and the conduit 49 allow air from an external air supply 53 (FIG. 5) to be delivered to the inflatable volume 63. As best illustrated in FIG. 11, in both embodiments of the invention, the inflatable volume 48 is formed with a piece of material 53 attached to the bottom surface 47 of the bottom panel 34 by various methods, for example, as disclosed in U.S. Pat. No. 8,246,706, hereby incorporated by reference. One or more air exit holes, i.e., non-adjustable air valves, generally referred to with the reference numeral 67, may be provided as well as one or more grommets or attachment points 65, As shown best in FIG. 11, the grommet or attachment point 65 is used to attach the material layer 53 to the bottom panel 34 in one location. It is contemplated that the grommet 65 may be omitted and alternatively multiple grommets or attachment points may be provided. The grommets 65 may be used to provide stability when the inflatable volume 63 is inflated.

As shown in FIG. 11, the arrows 71, 73 and 79 indicate the direction of the air flow into the inflatable volume 48. The arrows 75 and 77 illustrate the air being discharged from the air holes 67. The air being discharged from the air holes 67. The difference in air pressure between the air coming into the inflatable volume and air exiting the inflatable volume creates a lift to cause the mattress to lift relative to the foundation, as indicated by the lift arrows 87.

More specifically, the lifting force provided is directly proportional to the input air pressure to the inflatable volume relative to the air pressure exiting the inflatable volume multiplied by the area of the mattress. The lifting force directly opposes the downward force of the mattress due to weight of the mattress due to gravity. As such, the amount of lift of the mattress can be varied by varying the pressure of the air exiting the air discharge holes 67 and/or by way of the adjustable valves.

Figure 5:
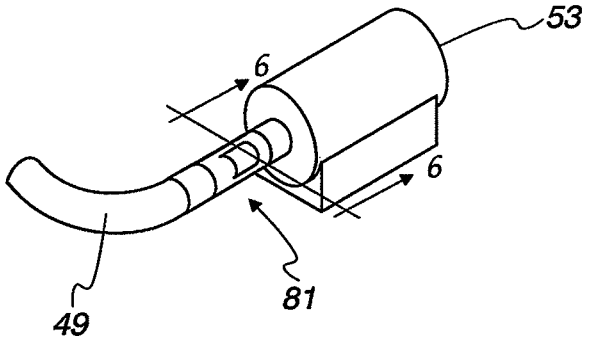
FIG. 5 is a partial isometric view of an air supply for use with the present invention, shown with a conduit for feeding the inflatable volume, illustrating one embodiment of an optional air discharge valve in the conduit for regulating the airflow.
Figure 6:
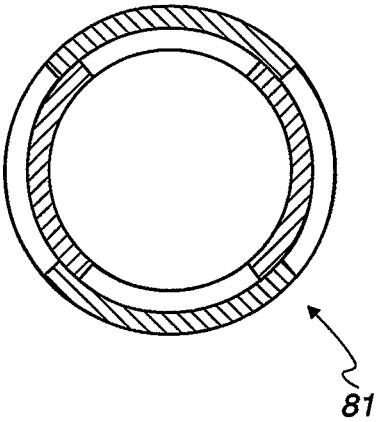
FIG. 6 is a sectional view of the valve illustrated in FIG. 5, shown with the valve closed.
Figure 7:
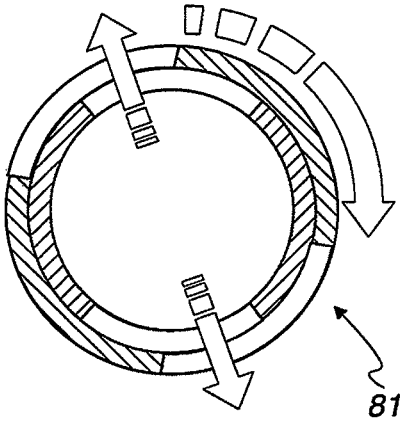
FIG. 7 is similar to FIG. 6 but shown with the valve partially open.

Various techniques are available for varying the pressure of the air exiting the air discharge holes 67. All but one of the techniques discussed below illustrate adjustable type devices in which the air pressure can be manually adjusted. One method of varying the pressure is illustrated in FIGS. 5-7. In this method, the pressure is varied by way of an air discharge valve 81 disposed in series with the conduit 49 from the air supply pump 53. Opening the air discharge valve 81 bleeds off air pressure from the air supply pump 53, thus supplying lower pressure air to the inflatable volume 63 (FIG. 11), thereby creating relatively less lift.

Figure 8:
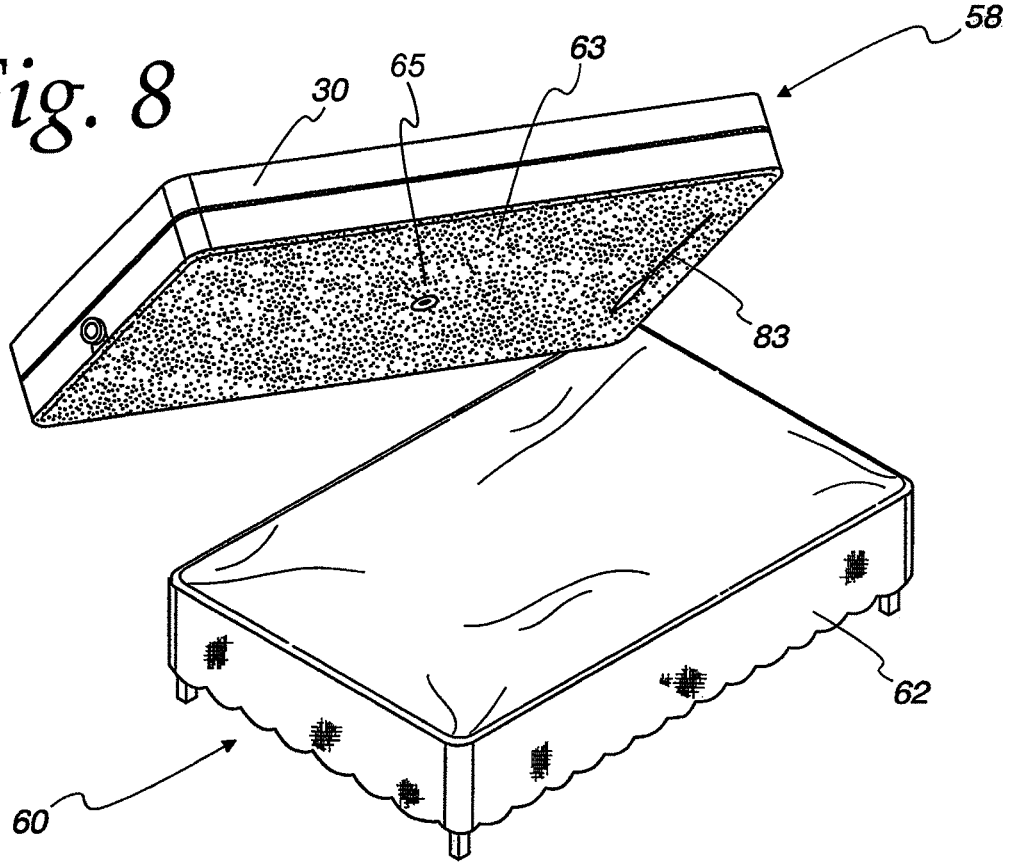
FIG. 8 is similar to FIG. 4 but shown without air discharge holes and with an attachment point and an embodiment of an air discharge valve, as illustrated in FIG. 8*a*, shown integrated into the inflatable volume for varying the air discharge from the inflatable volume.
Figure 8A:
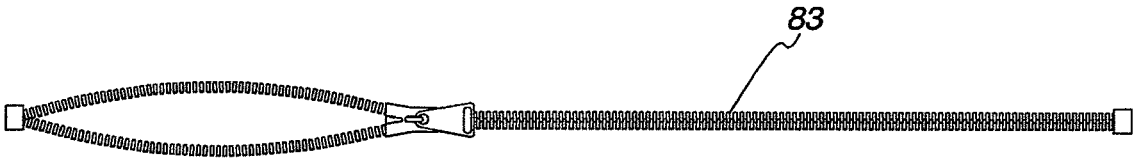
FIG. 8*a* is view of the air discharge valve illustrated in FIG. 8, shown partially open.
Figure 9:
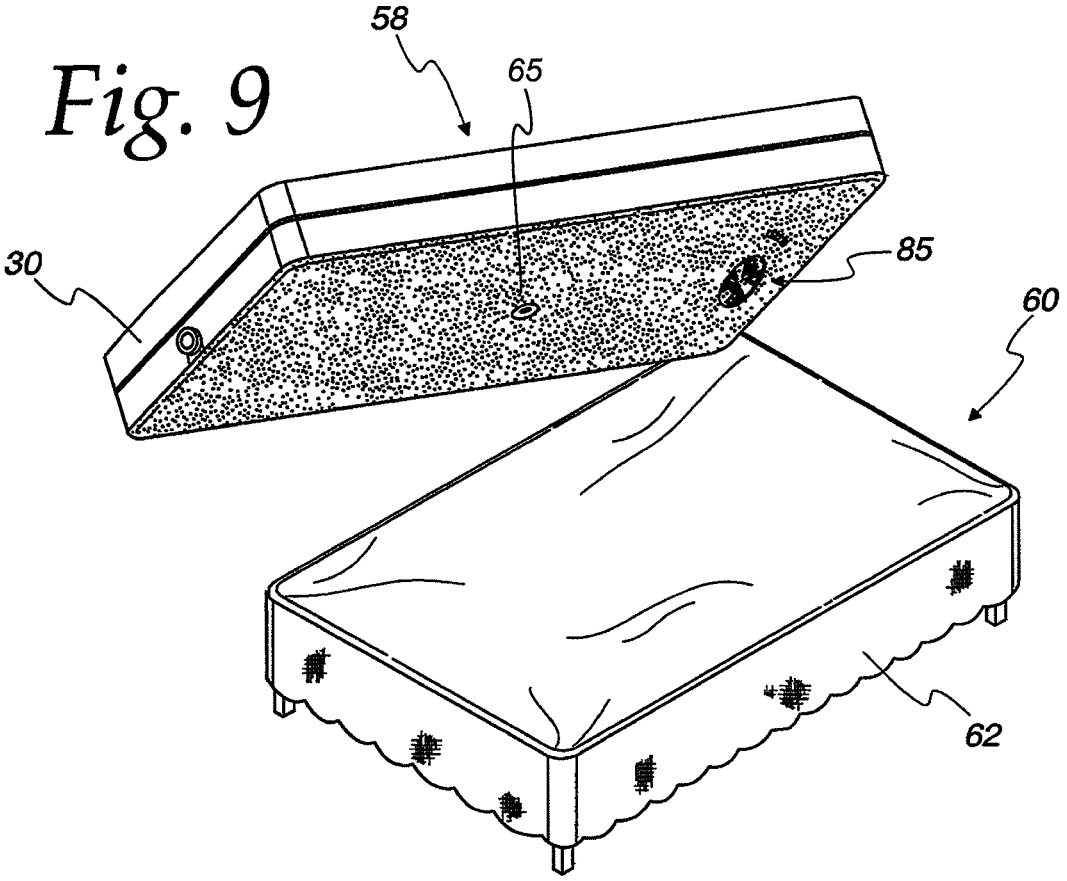
FIG. 9 is similar to FIG. 8 but shown with an alternate embodiment with an attachment point and an air discharge valve illustrated in FIG. 9*a*.
Figure 9A:
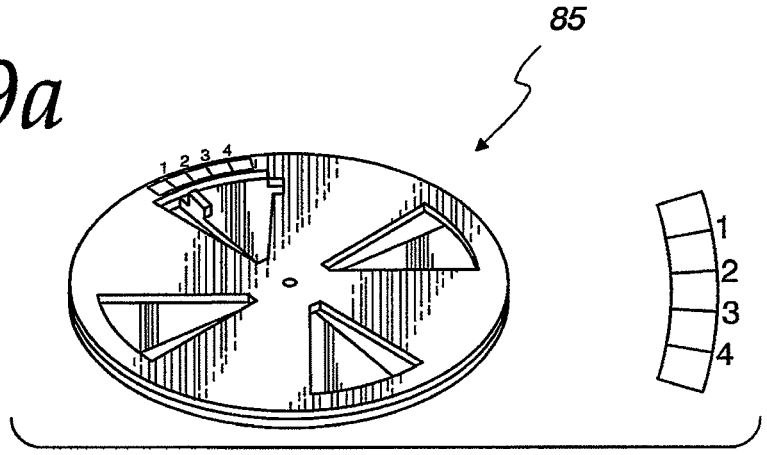
FIG. 9*a* is view of an alternate embodiment of an air discharge valve illustrated in FIG. 9, shown partially open.

FIGS. 8, 8*a*, 9 and 9*a* illustrate alternate optional adjustable air valves for varying the air pressure. FIGS. 8 and 8*a* illustrate the use of a zipper 83 which may be integrated on the material layer 53 (FIG. 11) as illustrated in FIG. 8. Similarly, FIGS. 9 and 9*a* illustrate an alternate type of valve 85 which may be juxtaposed on the material layer 53 (FIG. 11) as illustrated in FIG. 9.

Figure 10:
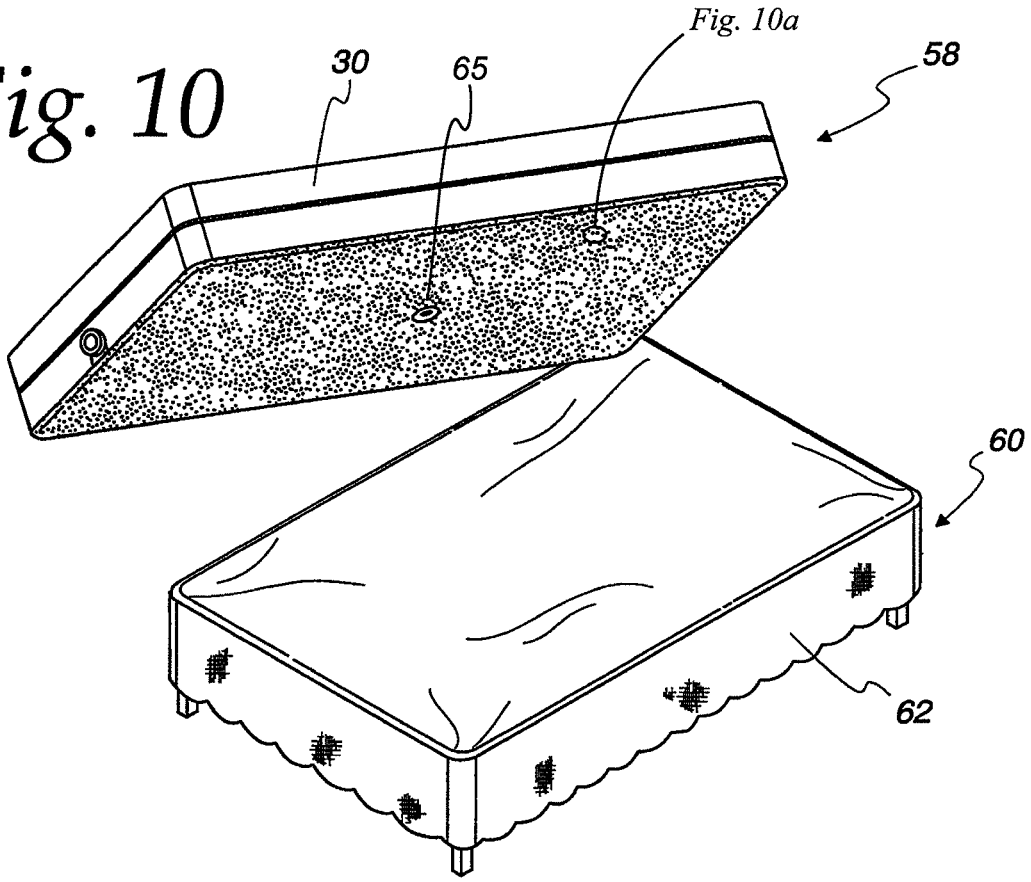
FIG. 10 is similar to FIG. 4, but illustrating an embodiment in which the porosity of the bottom panel of the encasement is used to control the air discharge as shown in FIG. 10*a*.
Figure 10A:
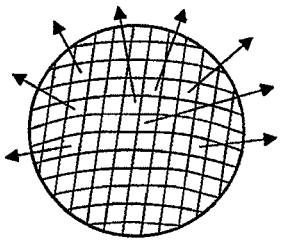

FIGS. 10 and 10*a* illustrate a non-adjustable method of controlling the pressure of the air exiting the inflatable volume 48. In this embodiment, the pressure is controlled by selecting a material with a porosity that provides the desired air pressure.

Of course, the pressure inside the inflatable volume can be controlled with one or more air discharge holes 67 (FIG. 11) in combination with one or more of the techniques discussed above. Alternatively, one or more of the techniques discussed above can be used to control the pressure inside the inflatable volume 48. All of such permutations and combinations are contemplated to be within the broad scope of the invention. Moreover, the principles of the present invention apply to embodiments with and without grommet(s) or attachment point(s) 65.

In accordance with another aspect of the invention, the encasement 30 (FIG. 1A) can be configured so that the size of the bottom portion of the encasement 30 is standard for all encasement depths. In this embodiment, the size of the top portion of the encasement 30 is formed to accommodate various encasement depths. In such an embodiment, the encasement 30 may be zippered on all four sides. The top portion includes the top panel 32 and the upper portions 42 of all four side panels 36. The bottom portion includes the bottom panel 34 and the lower portions 44 of all four side panels 36. In this embodiment, the transverse length (normal to the longitudinal length) of the upper portion 42 and the lower portion 44 of the side panels are not equal. The transverse length of the lower portion 44 of the side panel 36 may be set to a standard value. In order to accommodate encasements of different depths, the transverse length of the upper portions 42 of the side panels may vary as function of the overall depth of the encasement.

For example, a bottom portion of the encasement with a transverse length of 4 inches may be used with 8 inch and 10 inch encasements. For an mattress encasement with an 8 inch depth, an upper portion 42 with a 4 inch transverse length is used along with the 4 inch lower portion 44. For a 10 inch encasement, an upper portion 42 with a 6 inch transverse length is used along with the 4 in lower portion 44. Thus, the bottom portion of the encasement 30 may be standardized for different encasement depths.

Installation Of Bed Skirt and Encasement

In accordance with one aspect of the invention, FIGS. 12-17*a* illustrate the installation of a bed skirt 62 over a foundation 60 and the installation of an encasement 30 over the bed skirt 62 carried by the foundation 60. Unlike known encasements, installation and removal of the encasement 30 does not require extensive lifting or flipping of the mattress 58, as discussed above. In addition to facilitating installation and removal of the encasement over a mattress 58 or bed skirt 62, the encasement 30 provides various mattress management features, such as:

- Holding a bed skirt 62 in place while the encasement 30 is being installed on the mattress 58.
- Holding a bed skirt 62 in place while the mattress 58 is being rotated.
- Enabling the mattress 58 to be more easily rotated without lifting the mattress 58.
- Enabling the mattress 58 to be easily installed or removed to change and/or launder the bed skirt or the encasement.

Figure 12:
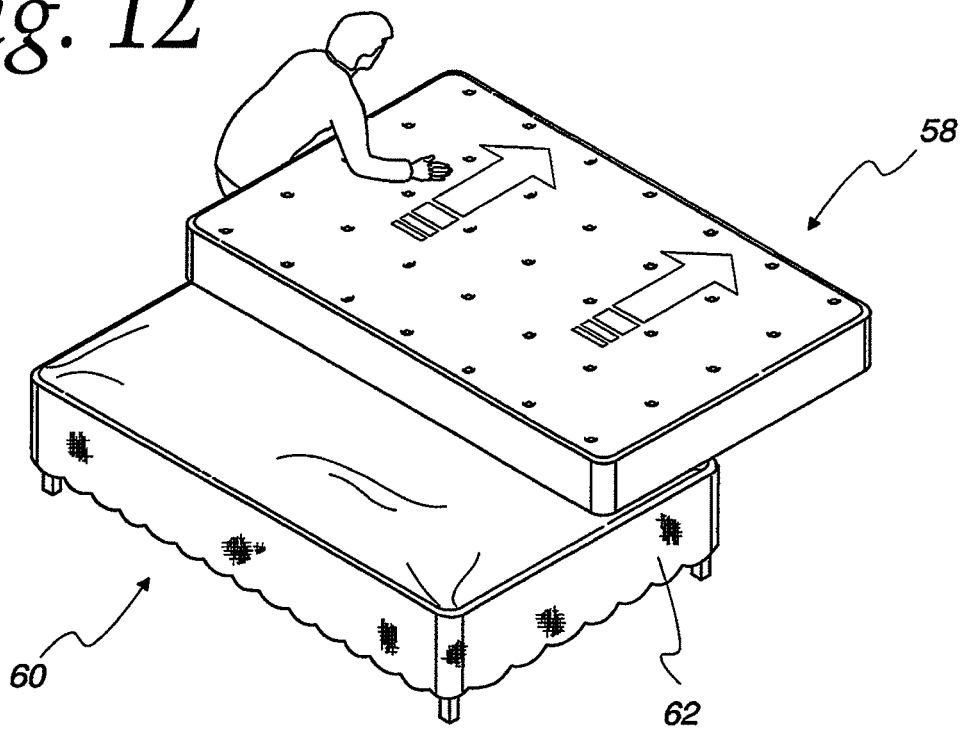
FIGS. 12 and 13 are isomeric views illustrating a mattress being removed from a foundation covered with a bed skirt, shown in disarray.
Figure 13:
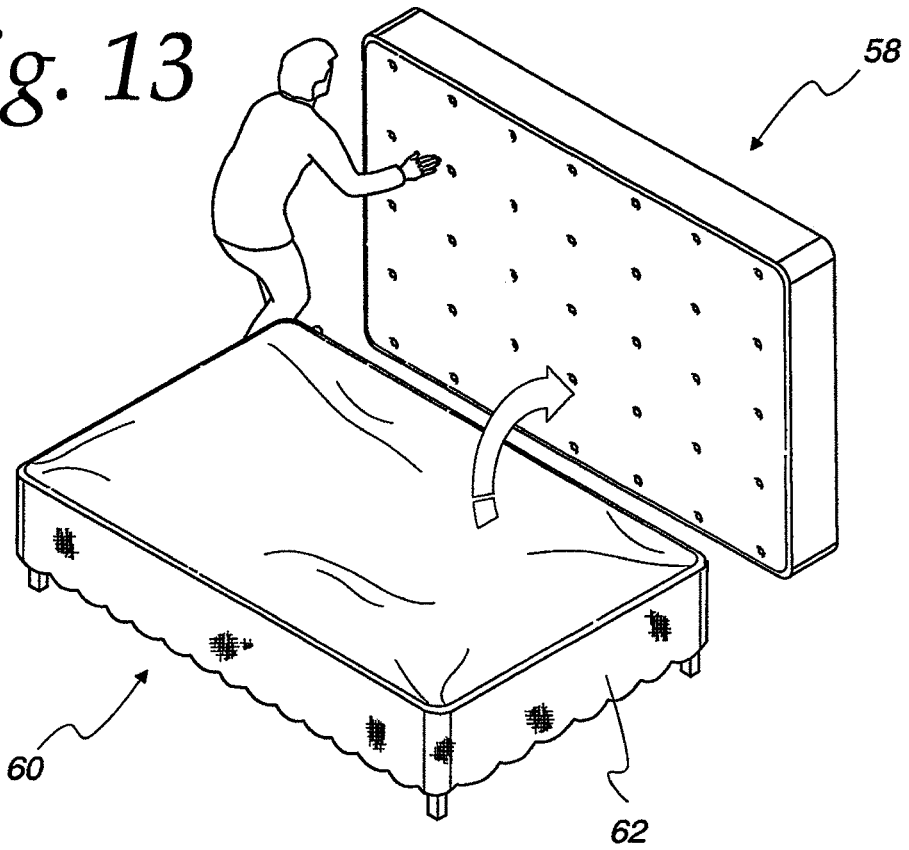
Figure 14:
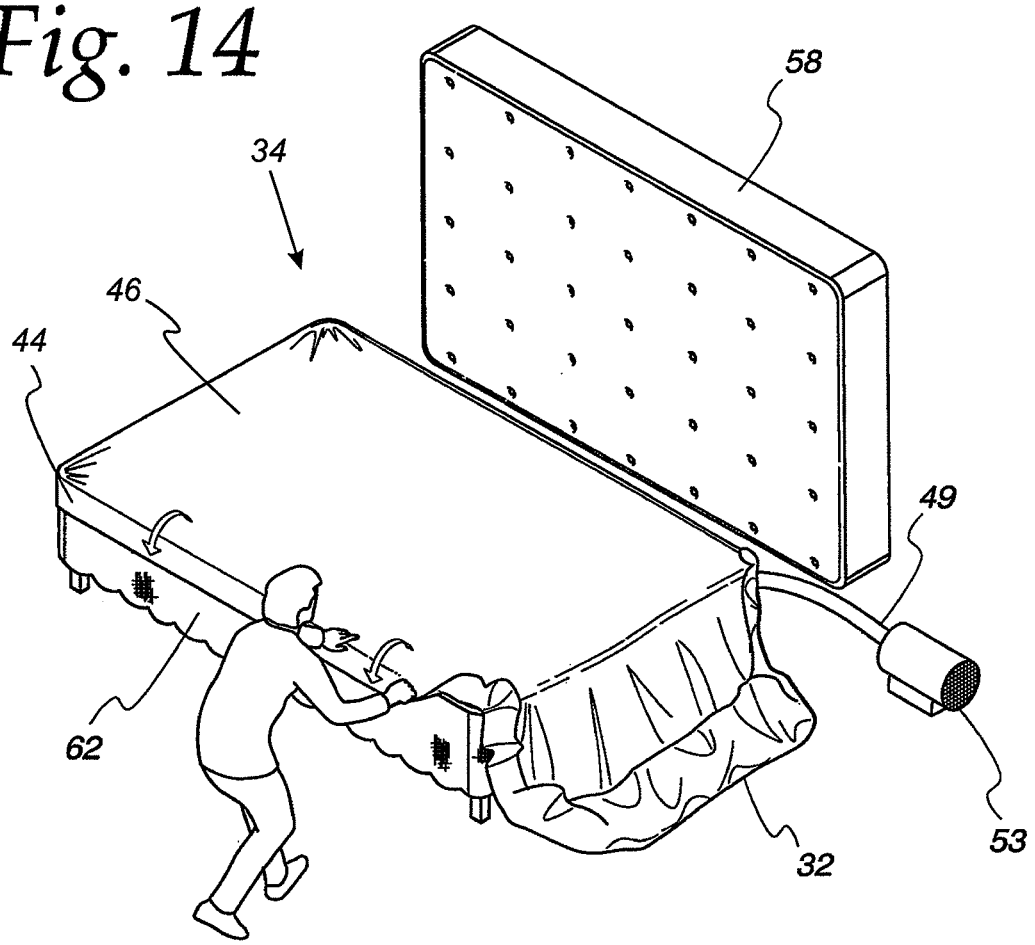
FIG. 14 illustrates one embodiment of an encasement in accordance with the present invention which includes three zippered sides shown with all three zippered sides unzipped and with a bottom panel in contact with a bed skirt covering the foundation and the top panel of the encasement on the floor at one end of the bed and a portion of the unzipped side panel resting on an interior surface of the bottom panel, shown illustrating a person unfolding the portion of the side panel that was resting on the interior surface of the bottom panel so that the side panel portions of the encasement are folded down and over the side panels of the bed skirt for those embodiments that have side panels.

Turning first to FIG. 12, the mattress 58 is slid off the foundation 60 and stood on one end, as illustrated. If desired, a bed skirt 62 may be installed or removed over the foundation 60. An important aspect of the invention is that the encasement 30 will hold the optional bed skirt 62 in place while the encasement 30 is being removed from or installed over the mattress 58. Once the bed skirt 62 is installed as illustrated in FIG. 13, the encasement 30 is placed over the bed skirt 62. As shown in FIG. 14, the encasement 30 is completely unzipped and the top cover 32 is disposed on the floor adjacent one end of the mattress 58.

Figure 15:
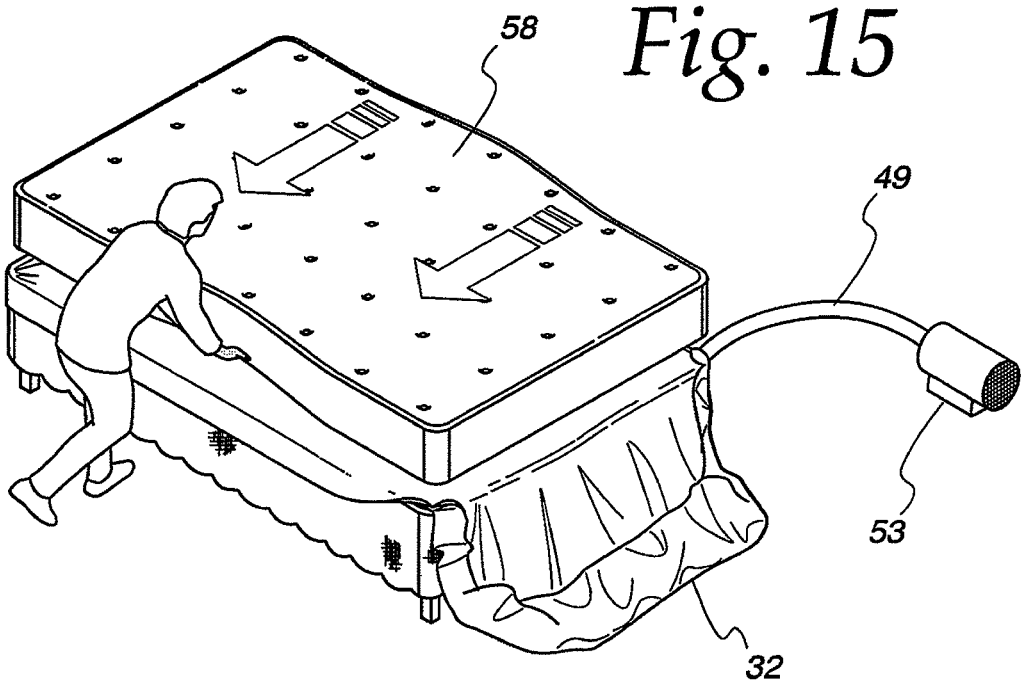
FIG. 15 illustrates the person sliding the mattress on top of the interior surface of the bottom panel of the encasement.

As shown in FIG. 14, the bottom portions 44 of the side panels 36 are resting on top of the slick interior surface 46 of the bottom panel 34. Prior to sliding the mattress 58 in place, lower portions 44 of the side panels 36 are folded down over the bed skirt 62 or alternatively, the foundation 60. Once the bottom portions 44 of the side panels 36 are completely folded down, the mattress 58 is slid in place over the interior surface 46 of the bottom panel 34 of the encasement 30, as illustrated in FIG. 15. The interior surface 46 of the bottom panel 34 is formed with a slick surface to facilitate sliding the mattress 58 into place. The exterior material 47 of the bottom panel 34 holds the encasement 30 in place over the bed skirt 62 or foundation 60 while the mattress 58 is being slid in place.

Once the mattress 58 is in place, the top panel 32 of the encasement is placed over the top of the mattress 58, as shown in FIG. 16. The encasement 30 is then zipped up by way of the zipper 40, as shown in FIG. 17.

FIGS. 18-21 illustrate a novel method of mattress management which relates to rotating a mattress 58 with an encasement 30. As mentioned above, mattresses can be relatively heavy and difficult to rotate. Moreover, an encasement covers up the mattress handles making it even more difficult to rotate the mattress. The novel method for rotating a mattress with an encasement overcomes these problems.

Figure 18:
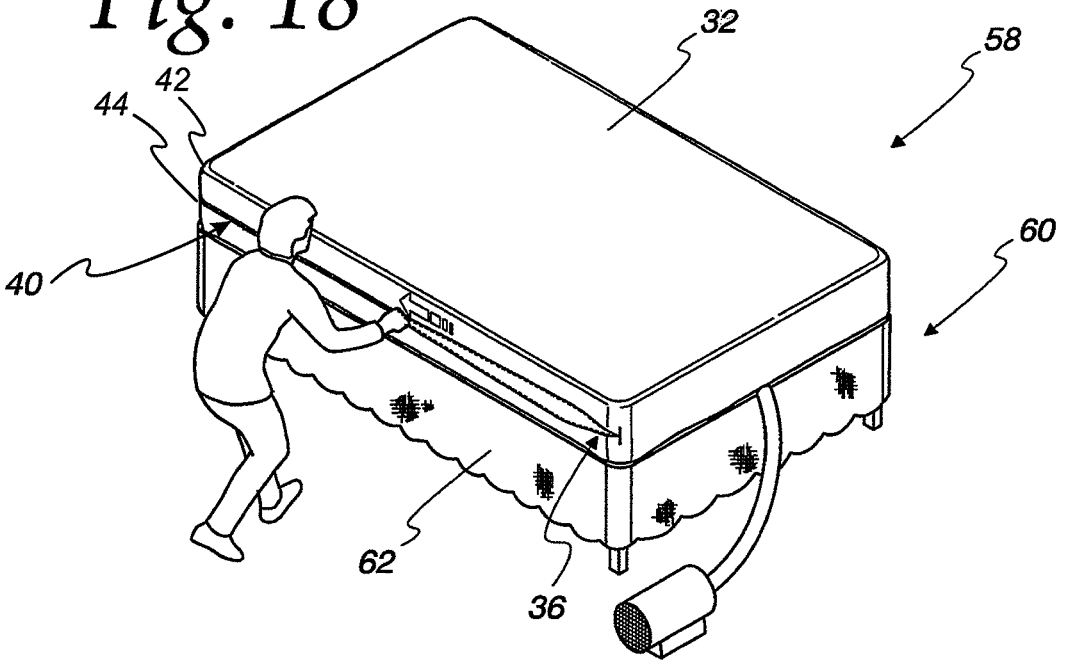
FIG. 18 is an isometric view of a mattress encased with an active encasement, illustrating the upper and lower side panel portions of the encasement being unzipped in preparation for rotation of the mattress, shown with the pump connected to the inflatable volume which is integrated into the bottom panel of the encasement.
Figure 19:
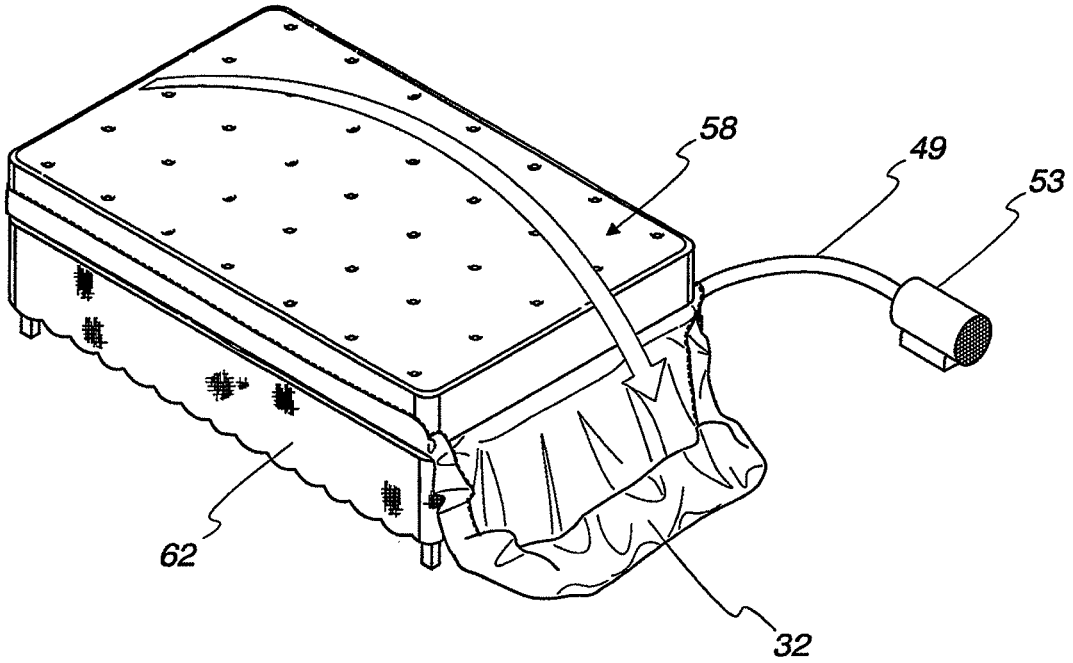
FIG. 19 illustrates the top panel of the encasement removed from the mattress and draped on the floor at one end of the mattress, shown with the pump connected to the inflatable volume which is integrated into the bottom panel of the encasement.
Figure 20:
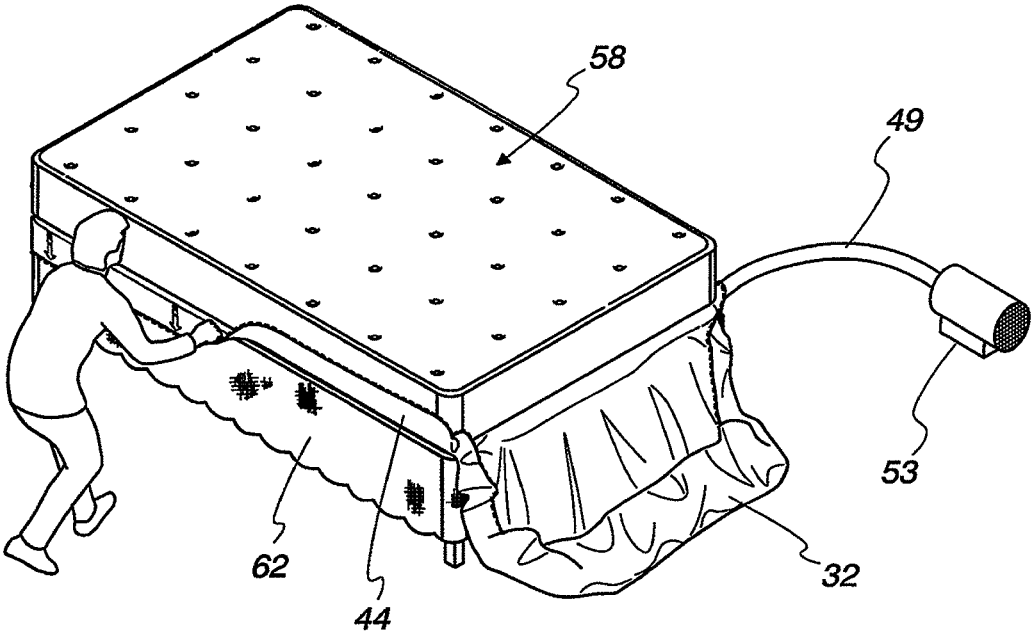
FIG. 20 illustrates the lower side panel portions of the encasement being folded down over the bed skirt, shown with the pump connected to the inflatable volume which is integrated into the bottom panel of the encasement.
Figure 21:
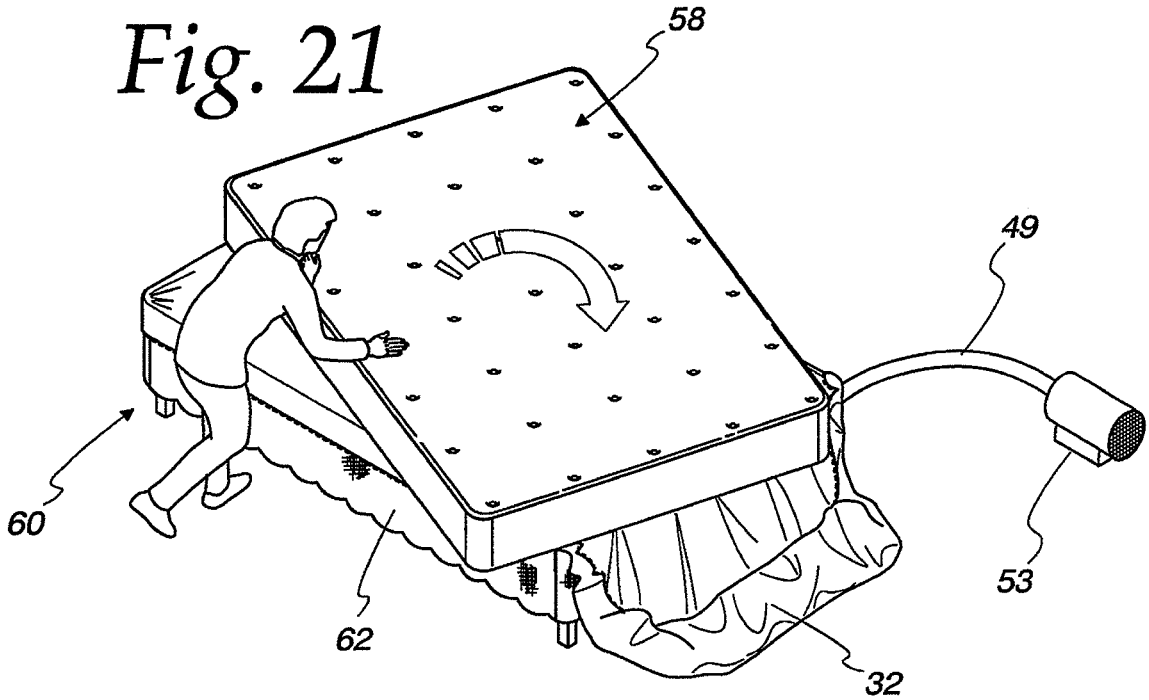
FIG. 21 illustrates rotation of the mattress relative to an interior surface of the bottom panel while the encasement and bed skirt remains in place, shown with the pump connected to the inflatable volume which is integrated into the bottom panel of the encasement.

Initially, as shown in FIG. 18, the zipper 40 is unzipped around all three sides 36. Once the zipper 40 is unzipped, the top panel 32 is draped on the floor on one end, as shown in FIG. 19. Next, as illustrated in FIG. 20, the lower portions 44 of the side panels 36 (FIG. 19) are folded over the sides of the bed skirt 62 or alternatively the sides of the foundation in applications where a bed skirt 62 is not used. Once the lower portions 44 of the side panels 36 are all folded down, the mattress 58 can be rotated, for example, 180 degrees, in a horizontal plane, as generally illustrated in FIG. 21. This is done to even out mattress wear and body impressions or indentations. In this application, the mattress handles (not shown) are exposed to facilitate rotation. The slick interior surface 46 (FIG. 1*a*) of the bottom panel 34 facilitates rotation while the non-slick exterior surface 48 of the bottom panel 34 holds the bottom panel 34 in place against the bed skirt 62 or alternatively, the foundation 60.

Once the mattress 58 is rotated in place, the top cover 32 is placed over the mattress 58, as shown in FIG. 16. The encasement 30 is then zipped up by way of the zipper 40, as shown in FIG. 17.

Second Embodiment

In an alternate embodiment of the invention, the inflatable volume 163 is formed as part of a separate cover 166 (FIG. 1*b*). In this embodiment, the encasement 130 is similar to the encasement 30 (FIG. 1*a*) except the encasement 130 does not include an inflatable volume integrally formed on the exterior surface of the bottom panel 34. Rather, in this embodiment, the exterior surface 147 of the bottom panel 134 of the encasement 130 may be formed at least partially as a slick surface or inherent coefficient of friction of mattress bottom, coated or uncoated.

The cover 166 includes a generally rectangular panel 168 optionally configured to attach to the bottom panel 134 of the encasement 30 and four (4) side panels generally identified with the reference numeral 170, which may be formed from a stretchable material. An inflatable volume 163 including a conduit 171 and an air intake nozzle 172 are formed on an exterior surface 174 of the rectangular panel 168. The cover 166 including the rectangular panel 168, the side panels 170 and the inflatable volume 148 may be configured, for example, as set forth above and disclosed in U.S. Pat. No. 8,246,706, hereby incorporated by reference, except as noted below. An interior surface 176 of the rectangular panel 168 is formed as a slick surface that is configured to cooperate with the slick surface 147 formed on the exterior of the bottom panel 134 of the encasement 130. In addition, the side panels 170 may be made from an elastic material, as set forth in the '706 patent or alternatively a non-elastic material. The inflatable volume 163 including any exposed exterior surface 174 of the rectangular panel 138 may be formed as a non-slick surface as defined herein.

Alternatively, the cover 166 (FIG. 1*b*) as well as the cover 200 (FIG. 37) may be formed from a single bottom panel with no side panels and attached to the encasement 130 with conventional fasteners or not attached at all. The cover 166 includes an inflatable volume, while the cover 200 does not. In these configurations, the panels 166, 200 may be attached by conventional means, such as Velcro, hook and loop, straps and/or buckle, buttons, snaps, zippers or other conventional fasteners as illustrated in FIGS. 31-37, 40 and 41. As used herein, the terms "attach" or "attached" means the side panels of the cover 166 (FIG. 1*b*) are juxtaposed over the sides of the encasement 130 or foundation 60 or bed skirt 62. Alternatively, "attach" or "attached" means attached by way of conventional fasteners, for example, as described herein.

The cover 166 and the encasement 130 may include conventional or non-conventional attachment means for attaching the cover 166 to the bottom panel 134 of the encasement 130 so that the slick surface 176 of the panel 168 engages and is in contact with the slick exterior surface 147 of the encasement 130. Virtually any type of attachment means are suitable, such as snaps, buckles, Velcro attachment or other conventional or non-conventional means are suitable for attaching the cover 166 to the encasement 130.

Mattress Rotation-Second Embodiment

In a normal mode of operation (FIG. 24), the cover 166 (FIG. 1*b*) is attached to the encasement 130 so that the inflatable volume 163 is in contact with the bed skirt 62 or foundation 60 and the slick surface 176 (FIG. 1*b*) of the cover 166 is in contact with the bottom surface 147 of the encasement 130. In this mode of operation, the side panels 170 of the cover 166 may be configured to hide the zipper 140 on the encasement 130. Since the bottom non-slick surface 174 of the cover 166 is in contact with the foundation 60 or bed skirt 62, it will provide a friction grip to hold the encased mattress 130 in place with respect to the foundation 60 of bed skirt 62.

In order to rotate the mattress 58, as shown in FIGS. 22-24, without removing the encasement 130, the cover 166 or the alternate cover consisting of a bottom panel with no side panels, is detached from the mattress 58 and the encasement 130 and folded down or juxtaposed over the foundation 60 or bed skirt 62 defining a rotate mode of operation, as illustrated in FIG. 22. In this mode of operation, the slick surface 176 of the cover 166 will be in contact with the bottom panel 134 of the encasement 130. The encased mattress 58 can then be rotated in a horizontal plane, as illustrated in FIG. 23, without removing the encasement 130 from the mattress 58. After the mattress 58 is rotated, the cover 166 may be removed from the foundation 60 or bed skirt 62 and attached to the encasement 130.

Third Embodiment

The third embodiment includes an encasement 130, as illustrated in FIG. 1*a* and a separate cover 200. In this embodiment of the invention, an encased mattress 58 can be rotated with an encasement 130, as illustrated in FIG. 1*a*, without removing the encasement 130. In this embodiment, a separate cover, for example, a cover like the covers 20, 22, described in detail in US Patent Application Publication No. 2013/0212809 A1, hereby incorporated by reference, may be provided, for example, as an add-on device for the encasement 130, as illustrated in FIG. 1*a*. The cover 200 (FIG. 37) includes generally rectangular panel with a non-slick surface 202 on one side and a slick surface 204 on an opposing side and may include four side panels 206.

An alternate embodiment of the cover 200 is illustrated in FIG. 1. and identified with the reference numeral 201. In this embodiment, the cover 201 includes a rectangular panel 203 and four (4) side panels 206. As shown best in FIG. 37*a*, the side panels 206 are extended and are folded over so as to overlap the underside of the rectangular panel 203. In this embodiment, the rectangular panel 203 may be made from a homogeneous material with no coatings in which both sides are slick. Alternatively, the rectangular panel 203 can include a slick or non-slick coating on one side or be made from a slick or non-slick material. Similarly, the side panels 206 may be made from another homogeneous material with no coatings in which both sides are non-slick. Alternatively, the side panels 206 can include or non-slick coatings and may be made from slick or non-slick material. The overlapping side panels 206 are fastened to the underside of the rectangular panel 203 by stitching or other permanent conventional means. By eliminating fabric coatings, the cover 201 can be made much less expensively than the cover 200. The cover 200 may alternatively include an inflatable volume similar to the cover 166 (FIG. 1*b*).

Mattress Rotation-Third Embodiment

In a normal mode of operation (FIG. 39), the cover 200 is attached to the outside of the encasement 130 so that the non-slick surface 202 is in contact with the foundation 60 or bed skirt 62 and the slick surface 204 is in contact with the bottom surface of the encasement 130. In a rotate mode of operation (FIG. 38), the cover 200 is detached from the encasement 130 and attached or juxtaposed over the foundation 60 or bed skirt 62. In this configuration the bottom surface of the inflatable volume 63 is in contact with the slick surface 204 of the cover 200. After the mattress 58 is rotated in a normal position, the cover 200 can be reattached to the encasement 130.

Figure 37A:
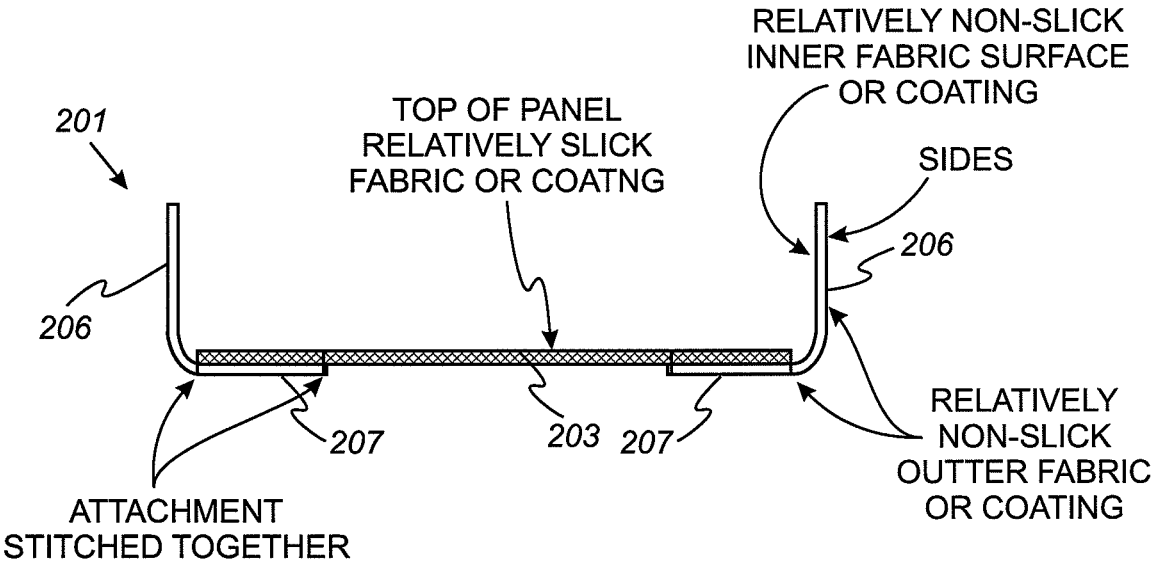
FIG. 37*a* is an alternate embodiment of the cover illustrated in FIG. 37 illustrating an embodiment in which the side panels overlap a portion of the rectangular panel of the cover, shown in a position in which it is attached to the underside of a mattress encasement.
Figure 37B:
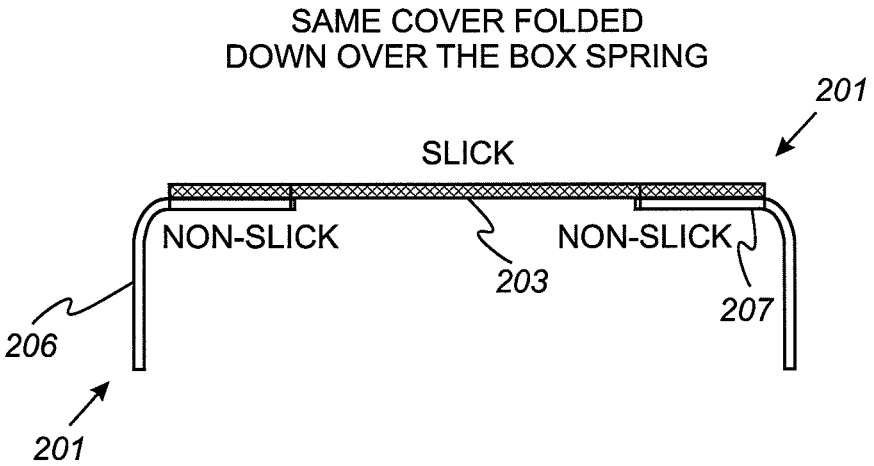
FIG. 37*b* is similar to FIG. 37*a* but shown in a position in which the cover is flipped down over a foundation.
Figure 37C:
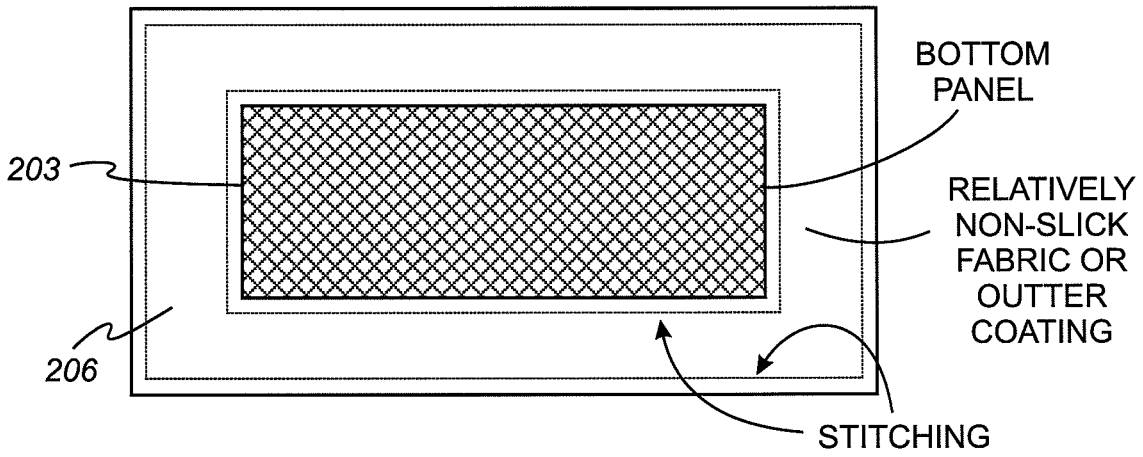
FIG. 37*c* is a bottom view of the embodiment illustrated in FIG. 37*a*.

Mattress rotation with the cover 201, illustrated in FIGS. 37*a*, 37*b* and 37*c*, is the same as with the cover 200, illustrated in FIG. 39. FIG. 37*a* illustrates the cover 201 in a normal mode of operation. In this mode of operation, the cover 201 is attached to the underside of the encasement 130. As shown best in FIG. 37*a*, the non-slick extensions 207 of the side panels 206 on the underside of the rectangular panel 203 will be in contact with the foundation 60 or bed skirt 62. In a rotate mode of operation, the cover 201 is folded down and attached to the foundation 60 or bed skirt 62, as illustrated in FIG. 37*b*. In this mode of operation, a slick surface of the cover 201 will be in contact with the underside of the encasement 130 (FIG. 1*a*), which may be formed with a slick surface. In this configuration, the surface of the inflatable volume 63 will be in contact with the slick surface of the cover 201 facilitating rotation.

Fourth Embodiment

FIGS. 37*d* and 37*e* illustrate a fourth embodiment of the invention. In this embodiment, similar to the embodiment illustrated in FIGS. 37*a*-37*c*, is configured to reduce the need for coatings on the material. Referring to FIG. 37*d*, an encasement 230 is illustrated. The encasement 230 is similar to the encasement 130 (FIG. 1*b*) and is configured to be used with a separate cover with an inflatable volume, such as the cover 166, illustrated in FIG. 1*b*, or the cover 200 (FIG. 37*a*). Alternatively, the encasement 230 may have an integral inflatable volume similar to FIG. 1*a*.

This embodiment includes a top cover 232, side covers 236 and a zipper 240, as well as a bottom panel 247. Except for the bottom panel 247, the encasement 230 is similar to the encasement 130, illustrated in FIG. 1*b*. In this embodiment, the bottom panel 247 may be formed from a homogeneous material with no coatings having slick surfaces on both sides. As shown best in FIG. 37*d*, the side panels 236 are formed to be extended so that the extensions 249 can be folded down over to overlap the underside of the bottom cover 247 and attached thereto by stitching or other permanent conventional means. In this embodiment, the side panels 236 are formed from a non-slick material, and may reduce the need to provide any coatings on the bottom panel 247.

Bed Making

The inflatable volume 63 (FIG. 1*a*) facilitates bed making, as illustrated in FIGS. 25-28. In particular, with reference to FIG. 25, the inflatable volume 63 is able to lift the mattress 58 with respect to the foundation 60 or bed skirt 62 to facilitate bed making. In a normal mode of operation, the air supply 53 is off and the encased mattress 58 sits firmly on the foundation 60 or bed skirt 62. When the air supply 53 is turned on the encased mattress 58 is lifted, as illustrated in FIG. 25-28. In particular, in response to air from the air supply 53 moving into the inflatable volume 63, as indicated by the in-flow arrows 252, this causes the optional inflatable volume 63 to expand, thus lifting the encased mattress 58, as shown and indicated by the lift arrows 253. Excess air is continuously vented through the adjustable or non-adjustable air valves.

FIGS. 26-28 illustrate the bed making process. Referring first to FIG. 26, a mattress 58 with an encasement 30 is shown supported by a foundation 60 with optional bed skirt 62. As shown in FIGS. 26-28, once the air supply 53 is turned on in an active mode, the encased mattress 58 is lifted, as discussed above, allowing a flat sheet 175 to be tucked between the encased mattress 58 and the foundation 60 or bed skirt 62, as best shown in FIG. 28, thus facilitating making of the bed without requiring excessive lifting of the mattress 58.

In embodiments, as illustrated in FIGS. 37*a*-37*c*, the side panel extensions 207 (FIG. 37*a*) may be formed from a slick material or material with a slick coating to facilitate tucking the sheets between the mattress 58 and a foundation 60 or platform.

One Size Fits All

As mentioned above, although the length and width dimensions of mattresses are standard, the depth dimensions vary considerably. In order to reduce the number of encasements that need to be manufactured, encasements are known to be manufactured to accommodate several depths for each mattress standard length and width size. A few commonly available encasements have depth ranges as set forth below.

6-9" depth
7-12" depth
9-12" depth
11-18" depth

Unfortunately, depending on the actual mattress depth, such encasements do not provide a snug fit. For example, a 6 inch depth mattress will not fit very snug in an encasement made to fit mattresses 6 to 9 inches thick.

Figure 30:
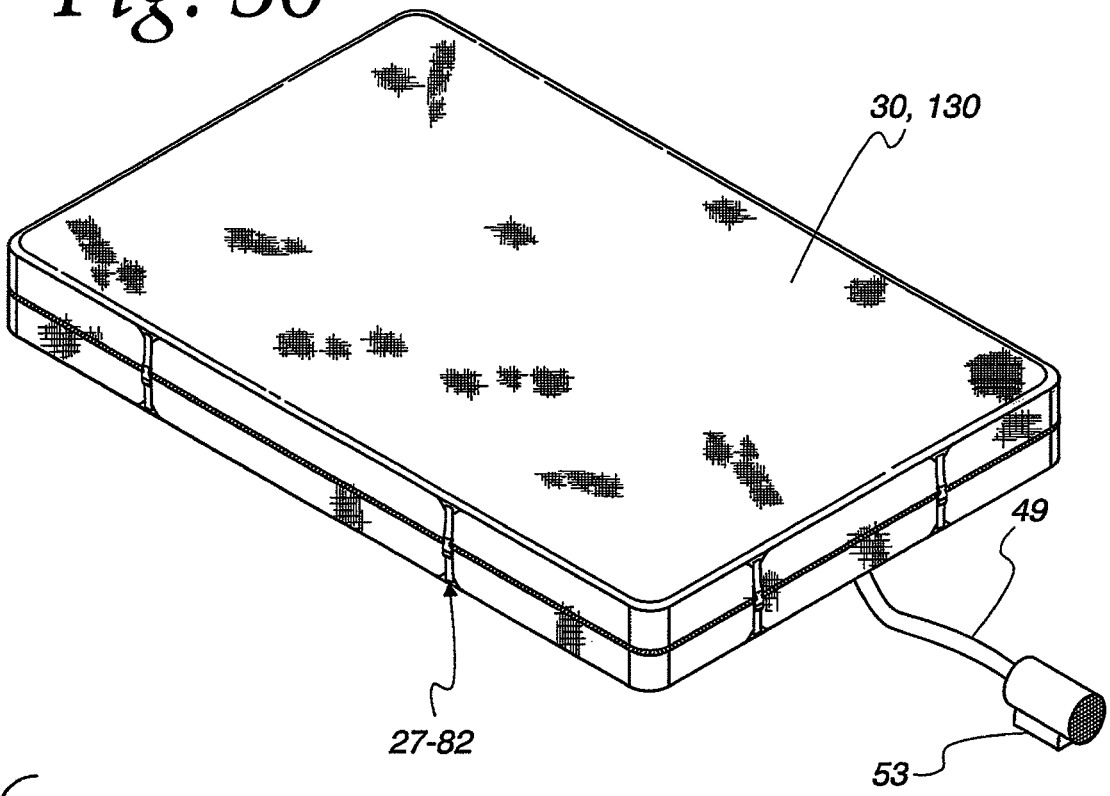
FIG. 30 is an isomeric view of an optional vertical adjustment device in accordance with the present invention, installed in various locations on the side panels of an encasement installed on a mattress to tighten the encasement with respect to a mattress in a vertical direction, shown with pump connected to the inflatable volume which is integrated into the bottom panel of the encasement.
Figure 31:
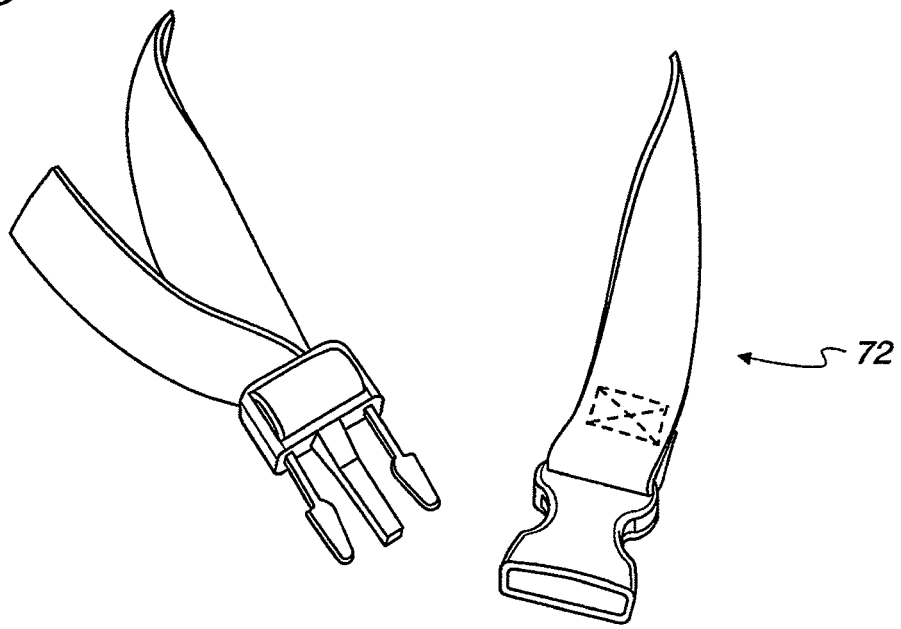
FIGS. 31-36 are partial isometric views of various optional adjustment devices for use with the present invention.
Figure 32:
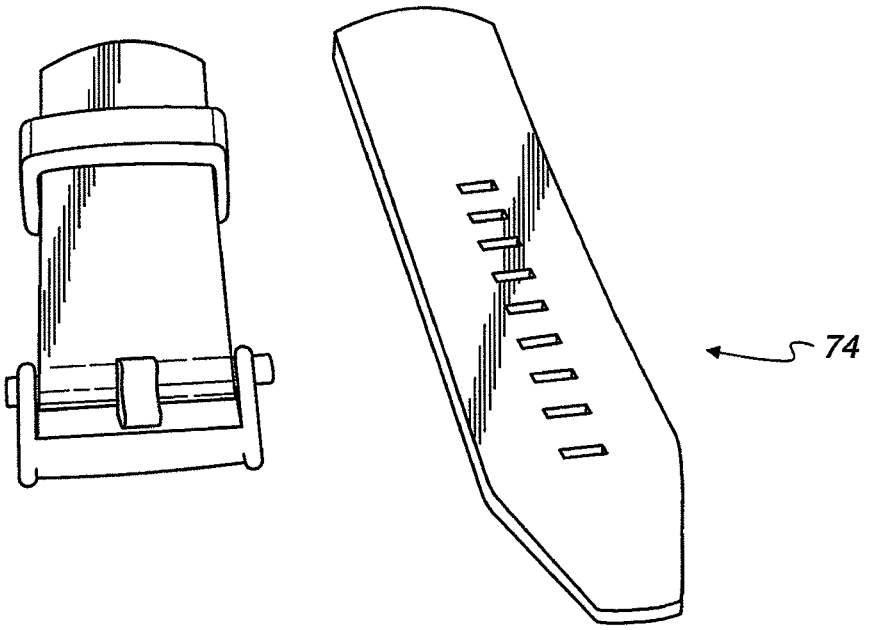
Figure 33:
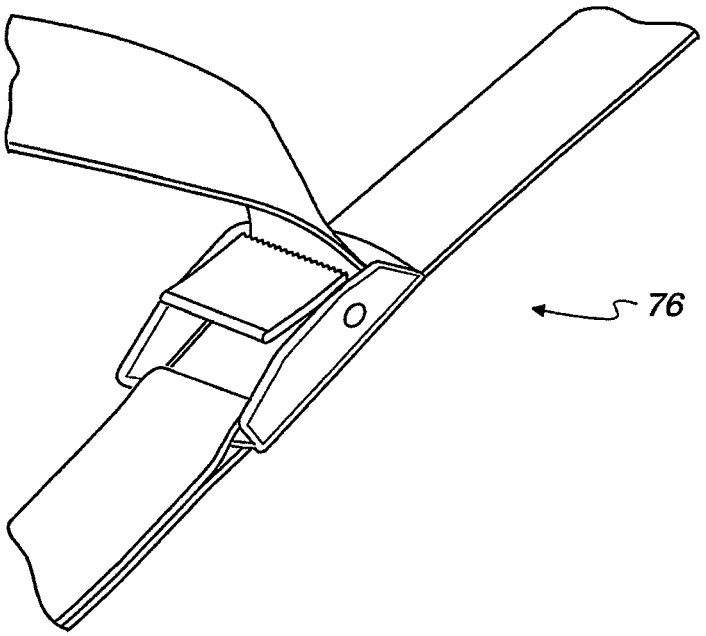
Figure 34:
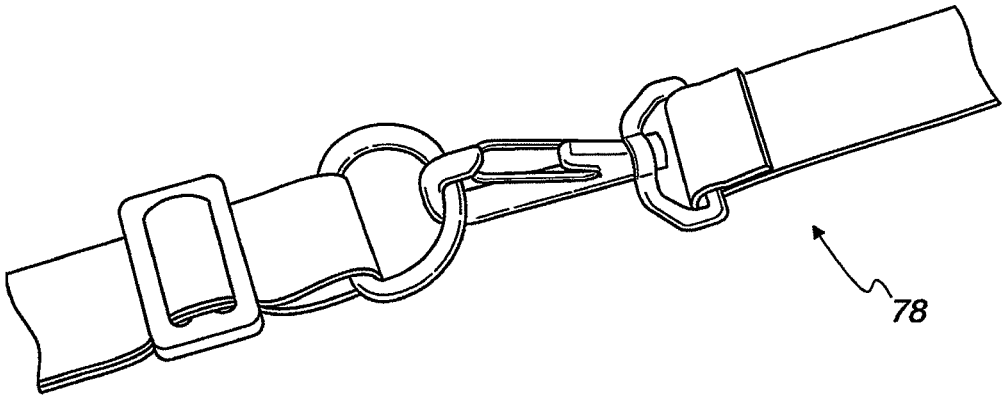
Figure 35:
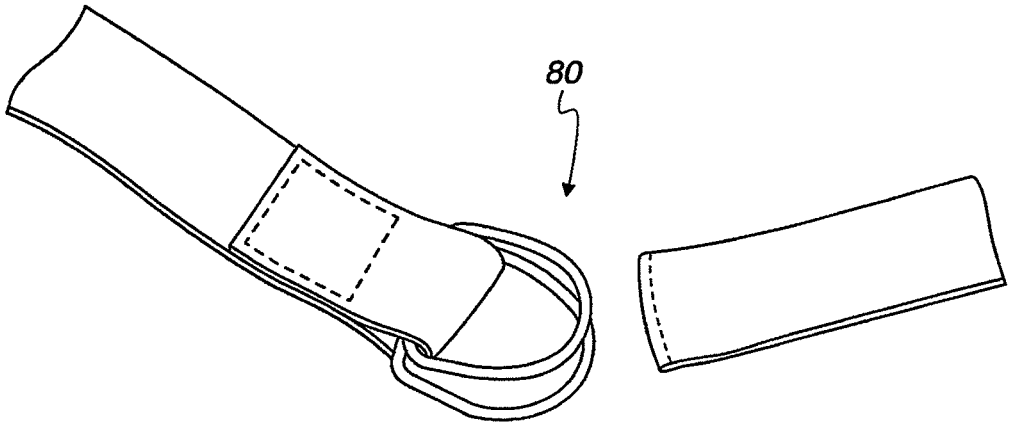
Figure 36:
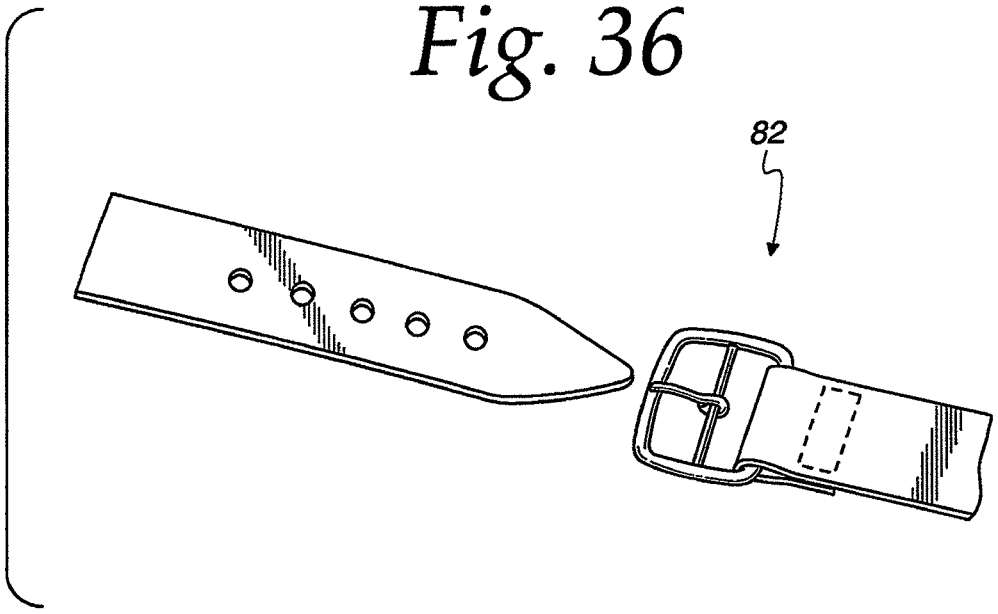

In order to provide a snug fit for encasements relative to the depth of mattresses and foundations, exemplary optional adjustable devices, for example, straps 72-82 are illustrated in FIGS. 31-37, respectively. Other adjustable devices are suitable. These adjustment devices may be connected between the upper portion 42 and the lower portion 44 of the side panels 36, as shown in FIG. 30. The adjustment devices may also be provided on the fixed side or un-zippered panel 38 (FIG. 1) to allow the encasement 30 to be snugged up against the mattress. In addition, the side panels 36 and 38 may be pleated to allow the excess portions to be neatly folded.

The straps illustrated in FIGS. 31-36 may be incorporated with conventional and non-conventional encasements or alternatively in combination with the novel encasements illustrated and described herein. These adjustment devices may also be used to attach the cover 166 (FIG. 1*b*) or cover 200 (FIG. 37) to the encasement 30 (FIG. 1*a*) or encasement 130 (FIG. 1*b*). All of such embodiments are contemplated by the present invention.

FIG. 40 illustrates optional horizontal adjustment devices, configured as straps, generally identified with the reference numeral 86. These horizontal straps 86 can be used to snug the encasement 30, 130 with respect to the mattress 58 in a horizontal direction. The straps 86 may be disposed below the zipper 40. As shown, Velcro® cinch type straps may be provided. Other adjustment devices are contemplated for tightening the encasement 30, 130 relative to the mattress 58. For example, the straps 72-82, discussed above, as well as button holes and buttons, or other conventional adjustment devices may be used. It is also contemplated that combinations of vertical and horizontal adjustment devices can be used.

FIG. 41 illustrates and alternate embodiment of the horizontal adjustment devices 86 in FIG. 40. In this embodiment, a ring 88 is provided to enable the strap 86 to be looped there through and tightened. Both embodiments, illustrated in FIGS. 40 and 41 may be used as horizontal adjustment devices, as shown, and/or vertical adjustment devices.

Obviously, many modifications and variations of the present invention are possible in light of the above teachings. For example, materials for the covers and slick surfaces other than those mentioned above can be which have similar co-efficient of friction characteristics. Thus, it is to be understood that, within the scope of the appended claims, the invention may be practiced otherwise than as specifically described above.

What is claimed is:

1. An active encasement for a mattress or foundation comprising:

a top panel defining an exterior surface and an interior surface;

a bottom panel to facilitate rotation of the mattress with respect to the bottom panel as well as installation and removal of the mattress or foundation with respect to the encasement;

an inflatable volume formed at least in part from at least a portion of the bottom panel, the inflatable volume configured to be in communication with an external air supply;

a plurality of separable side panels configured to form the encasement with the top panel and the bottom panel, the plurality of side panels including contiguous separable side panel portions on two or more side panels, each separable side panel defining a separable upper portion and a separable lower portion, the separable upper portions attached to the top panel and the separable lower portions attached to the bottom panel, the separable upper portions and the separable lower portions attachable or detachable with respect to each other; and a zipper for attaching or alternatively detaching the separable upper side panel portions to the separable lower side panel portions the two or more separable side panels in a normal mode of operation and alternatively at least partially detaching the separable upper side panel portions from the separable lower side panel portions of the two or more separable side panel portions in an alternate rotating or sliding mode of operation to enable at least a portion of the top panel to be at least partially removed from the mattress or foundation to enable movement of the mattress or foundation with respect to the bottom panel.

2. The encasement as recited in claim 1, wherein the inflatable volume includes an air discharge hole.

3. The encasement as recited in claim 1, wherein the inflatable volume includes an adjustable air discharge hole formed from a zippered valve.

4. The encasement as recited in claim 1, wherein the inflatable volume includes at least one attachment point spaced away from an outermost perimeter of the inflatable volume.

5. The encasement as recited in claim 1, wherein the inflatable volume includes at least one attachment point in communication with an outermost perimeter of the inflatable volume.

6. An encasement for a mattress or a foundation, the mattress and the foundation having side panels, the encasement comprising:

a top panel;

a bottom panel, wherein the top panel and the bottom panel also form side panels that are formed to cover the sides of the mattress or the foundation, the top panel and the bottom panel are configured to be secured together to form the encasement;

an inflatable volume formed at least in part from at least a portion of the bottom panel, the inflatable volume configured to be in communication with an external source of air, wherein the inflatable volume includes an adjustable air discharge hole formed from a zippered valve; and a zipper for selectively connecting or alternatively disconnecting the top panel with respect to the bottom panel on contiguous separable portions of one or more side panels in a normal mode of operation and alternatively at least partially disconnecting the top panel from the bottom panel on at least one or more contiguous separable side panel portions in an alternate rotating or sliding mode of operation to enable at least a portion of the top panel to be at least partially removed from the mattress or foundation to enable movement of the mattress or foundation with respect to the bottom panel.

7. The encasement as recited in claim 6, wherein the inflatable volume includes an adjustable air discharge hole.

8. The encasement as recited in claim 6, wherein the inflatable volume includes a fixed air discharge hole.

9. The encasement as recited in claim 6, wherein the inflatable volume includes at least one attachment point spaced away from an outermost perimeter of the inflatable volume.

10. The encasement as recited in claim 6, wherein the inflatable volume includes at least one attachment point in communication with an outermost perimeter of the inflatable volume.

11. An active encasement for a mattress or foundation comprising: a top panel;

a bottom panel;

an inflatable volume formed at least in part from at least a portion of the bottom panel, the bottom panel configured to be in communication with an external air supply;

a plurality of side panels connecting the top panel to the bottom panel to form the encasement;

a removable side panel secured to one or the other of the upper panel and the bottom panel and selectively secured to the other of the upper panel and the bottom panel, the removable side panel also selectively secured to one or more contiguous side panels;

a zipper for selectively connecting the removable side panel to one or the other of the upper panel and the bottom panel and the one or more contiguous side panels in a normal mode of operation and alternatively disconnecting two or more of the removable side panel from one or the other of the upper panel and the bottom panel and the one or more contiguous side panels in an alternate rotating or sliding mode of operation to facilitate insertion and removal of a mattress or foundation through the removable side panel.

12. The encasement as recited in claim 11, wherein the inflatable volume includes a fixed air discharge hole.

13. The encasement as recited in claim 11, wherein the inflatable volume includes an adjustable air discharge hole.

14. The encasement as recited in claim 11, wherein the inflatable volume includes an adjustable air discharge hole formed from a zippered valve.

15. The encasement as recited in claim 11, wherein the inflatable volume includes at least one attachment point spaced away from an outermost perimeter of the inflatable volume.

16. The encasement as recited in claim 11, wherein the inflatable volume includes at least one attachment point in communication with an outermost perimeter of the inflatable volume.

* * * * *